US009751711B2

(12) United States Patent
Ogawa

(10) Patent No.: US 9,751,711 B2
(45) Date of Patent: Sep. 5, 2017

(54) BOOKBINDING APPARATUS WITH SHEET INSERTER

(71) Applicant: RISO KAGAKU CORPORATION, Minato-ku, Tokyo (JP)

(72) Inventor: Hideaki Ogawa, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 34 days.

(21) Appl. No.: 14/749,346

(22) Filed: Jun. 24, 2015

(65) Prior Publication Data

US 2015/0375953 A1 Dec. 31, 2015

(30) Foreign Application Priority Data

Jun. 30, 2014 (JP) ..... 2014-133534

(51) Int. Cl.

| | |
|---|---|
| ***B65H 33/04*** | (2006.01) |
| ***B65H 5/06*** | (2006.01) |
| ***B65H 7/20*** | (2006.01) |
| ***B65H 31/26*** | (2006.01) |
| ***B65H 37/04*** | (2006.01) |
| ***B65H 43/06*** | (2006.01) |
| ***B42C 1/12*** | (2006.01) |
| ***B42C 11/04*** | (2006.01) |

(Continued)

(52) U.S. Cl.

CPC ..... *B65H 33/04* (2013.01); *B42C 1/12* (2013.01); *B42C 11/04* (2013.01); *B42C 19/02* (2013.01); *B65H 5/06* (2013.01); *B65H 7/20* (2013.01); *B65H 31/26* (2013.01); *B65H 37/04* (2013.01); *B65H 39/02* (2013.01); *B65H 43/06* (2013.01); *G03G 15/6514* (2013.01); *G03G 15/6538* (2013.01); *B65H 2301/4381* (2013.01); *B65H 2801/27* (2013.01); *G03G 2215/00561* (2013.01); *G03G 2215/00869* (2013.01)

(58) Field of Classification Search

CPC ..... B65H 33/04; B65H 31/26; B65H 43/06; B65H 7/20; B65H 5/06

USPC ..... 270/58.32, 58.31; 399/382

See application file for complete search history.

(56) References Cited

U.S. PATENT DOCUMENTS 6,567,187 B1 5/2003 Iwasaki et al.
7,447,477 B2 * 11/2008 Fukatsu ..... B65H 39/042 399/381

(Continued)

FOREIGN PATENT DOCUMENTS

JP 2000001230 A 1/2000
JP 2013244674 A 12/2013

OTHER PUBLICATIONS

Extended European Search Report dated Nov. 18, 2015, issued in counterpart European Application No. 15173602.2.

*Primary Examiner* — Patrick Mackey
(74) *Attorney, Agent, or Firm* — Holtz, Holtz & Volek PC

(57) ABSTRACT

An aligning unit stores a paper bundle that is formed by inserting a medium that is different from printed body text paper sheets conveyed from a printer into the printed body text paper sheets. A manual paper feeding unit stores a medium that is manually fed. A conveyance control unit makes the medium be conveyed from the manual paper feeding unit to the aligning unit after the body text paper sheets that include a page specified by a print job are stored in the aligning unit and before the body text paper sheet conveyed from the printer immediately afterwards is stored in the aligning unit.

2 Claims, 18 Drawing Sheets

(51) Int. Cl.

| | |
|---|---|
| ***B42C 19/02*** | (2006.01) |
| ***B65H 39/02*** | (2006.01) |
| ***G03G 15/00*** | (2006.01) |

(56) References Cited

U.S. PATENT DOCUMENTS

| | | | | |
|---|---|---|---|---|
| 8,038,139 | B2 * | 10/2011 | Nishimura | B42C 1/12 270/58.23 |
| 8,078,078 | B2 * | 12/2011 | Matsumoto | H04N 1/00957 399/382 |
| 2003/0170059 | A1 * | 9/2003 | Koga | B41J 13/103 399/381 |
| 2003/0235446 | A1 * | 12/2003 | Kudo | G03G 15/655 399/382 |
| 2004/0022564 | A1 * | 2/2004 | Fujii | G03G 15/655 399/382 |
| 2004/0195754 | A1 * | 10/2004 | Sheffels | B65H 33/04 270/58.31 |
| 2007/0048051 | A1 * | 3/2007 | Nakajima | G03G 15/6573 399/382 |
| 2008/0230976 | A1 * | 9/2008 | Tabuchi | B65H 7/20 270/58.31 |
| 2010/0252984 | A1 * | 10/2010 | Maeda | G03G 15/655 270/58.23 |
| 2014/0042686 | A1 * | 2/2014 | Konishi | B65H 29/125 270/58.31 |
| 2016/0202651 | A1 * | 7/2016 | Yamada | G03G 15/50 399/382 |

* cited by examiner

PLACEMENT INSTRUCTION

PLEASE OPEN UPPER SURFACE COVER OF CASE BOOKBINDING DEVICE, AND DIRECTLY PLACE MEDIUM (PAPER BUNDLE) TO BE MANUALLY FED IMMEDIATELY BEFORE SEVENTH PAGE ON STACK TRAY.

PLEASE SELECT "CONTINUE" BUTTON AFTER PLACEMENT.

CANCEL CONTINUE

F I G. 7 A

STORAGE INSTRUCTION

MEDIUM (PAPER BUNDLE) TO BE MANUALLY FED HAS NOT BEEN STORED IN PAPER FEEDING TRAY.
PLEASE STORE MEDIUM (PAPER BUNDLE) TO BE MANUALLY FED IN PAPER FEEDING TRAY.

PLEASE SELECT "CONTINUE" BUTTON AFTER STORAGE.

CANCEL CONTINUE

F I G. 7 B

REMOVAL INSTRUCTION

MEDIUM (PAPER BUNDLE) IN PAPER FEEDING TRAY CANNOT BE AUTOMATICALLY CONVEYED BECAUSE THICKNESS EXCEEDS CONVEYABLE THICKNESS.
PLEASE REMOVE MEDIUM (PAPER BUNDLE) FROM PAPER FEEDING TRAY.
WHEN PLURAL MEDIA (PAPER BUNDLES) HAVE BEEN STORED, PLEASE REMOVE MEDIUM (PAPER BUNDLE) AT BOTTOM.

PLEASE SELECT "CONTINUE" BUTTON AFTER REMOVAL.

CANCEL CONTINUE

F I G. 7 C

T1

| SPECIFIED PAGE | INSERTION POSITION | FLAG |
|---|---|---|
| 3 | 2 | 1 |
| 7 | 4 | 0 |
| 8 | 5 | 1 |

FIG. 8

BOOKBINDING APPARATUS WITH SHEET INSERTER

CROSS-REFERENCE TO RELATED APPLICATION

This application is based upon and claims the benefit of priority of the prior Japanese Patent Application No. 2014-133534, filed on Jun. 30, 2014, the entire contents of which are incorporated herein by reference.

BACKGROUND OF THE INVENTION

Field of the Invention

The present invention relates to a bookbinding apparatus.

Description of the Related Art

Some printers correspond to a bookbinding function. These printers can manufacture booklets by being coupled to, for example, a case bookbinding device.

When manufacturing a booklet, in general, original data to be processed is printed on printing paper sheets, the printing paper sheets on which an original content has been printed are stacked, and a booklet is manufactured. Meanwhile, ready-made printed matter such as a catalog is desired to be inserted as a portion of the booklet.

As a method applicable to solving this problem, manual paper feeding has been proposed. Manual paper feeding is a method for feeding media such as printing paper sheets one at a time from a paper feeding tray for manual paper feeding. Technologies relating to manual paper feeding include a technology that was proposed, for example, in Patent Document 1 (Japanese Laid-open Patent Publication No. 2000-1230).

In the technology proposed in Patent Document 1, a paper ejection sensor is provided on the downstream side of a paper path of a recording head, a manually fed sheet is conveyed by an amount sufficient to reach the paper ejection sensor, and it is determined whether the paper ejection sensor has detected the sheet. When the paper ejection sensor has not detected the sheet, the sheet is returned to the side of a manual paper feeding tray, and manual paper feeding is stopped. This allows a problem of misfeeding of a sheet to be solved with the technology proposed in Patent Document 1, for example.

SUMMARY OF THE INVENTION

However, in the technology proposed in Patent Document 1, a sheet (printing paper sheet) is manually fed as a cover of a booklet to be manufactured, and a case in which a ready-made printed matter is manually fed as a portion of a booklet is not considered, nor is a case in which a ready-made printed matter is inserted into a booklet considered.

In view of the problem above, an object of the present invention is to provide a bookbinding apparatus that enables a user to manually feed a portion of a booklet to be manufactured at a desired timing.

A bookbinding apparatus according to the first invention includes a storing unit that stores a paper bundle that is formed of printed body text paper sheets conveyed from a printer and a medium that is inserted into the body text paper sheets and that is different from the body text paper sheets, a storage unit that stores the medium that is manually fed, a conveyance unit that conveys the medium from the storage unit to the storing unit, and a control unit that controls the conveyance unit so as to insert the medium into the body text paper sheets on the basis of a page specified by a print job, and the control unit controls the conveyance unit so as to convey the medium from the storage unit to the storing unit after the body text paper sheets that include the specified page are stored in the storing unit and before the body text paper sheet conveyed from the printer immediately afterwards is stored in the storing unit.

The bookbinding apparatus according to the first invention includes a storing unit that stores a paper bundle that is formed by inserting a medium (an object to be manually fed) that is different from printed body text paper sheets conveyed from a printer into the printed body text paper sheets, a storage unit that stores the medium to be manually fed, a conveyance unit that conveys the medium to be manually fed that is stored in the storage unit to the storing unit, and a control unit that controls the conveyance unit. The control unit controls the conveyance unit so as to convey the medium to be manually fed to the storing unit after body text paper sheets that include a page specified by a print job are stored in the storing unit and before a body text paper sheet conveyed from the printer immediately afterwards is stored in the storing unit. This allows a user to manually feed a portion of a manufactured booklet at a desired timing.

BRIEF DESCRIPTION OF THE DRAWINGS

FIG. 7A illustrates an example of a placement instruction screen according to the embodiment.

FIG. 7B illustrates an example of a storage instruction screen according to the embodiment.

FIG. 7C illustrates an example of a removal instruction screen according to the embodiment.

FIG. 8 illustrates an exemplary configuration of an automatic paper-feeding-propriety management table according to the embodiment.

DETAILED DESCRIPTION OF THE PREFERRED EMBODIMENTS

An embodiment of the present invention is described below with reference to the drawings.

Figure 1:
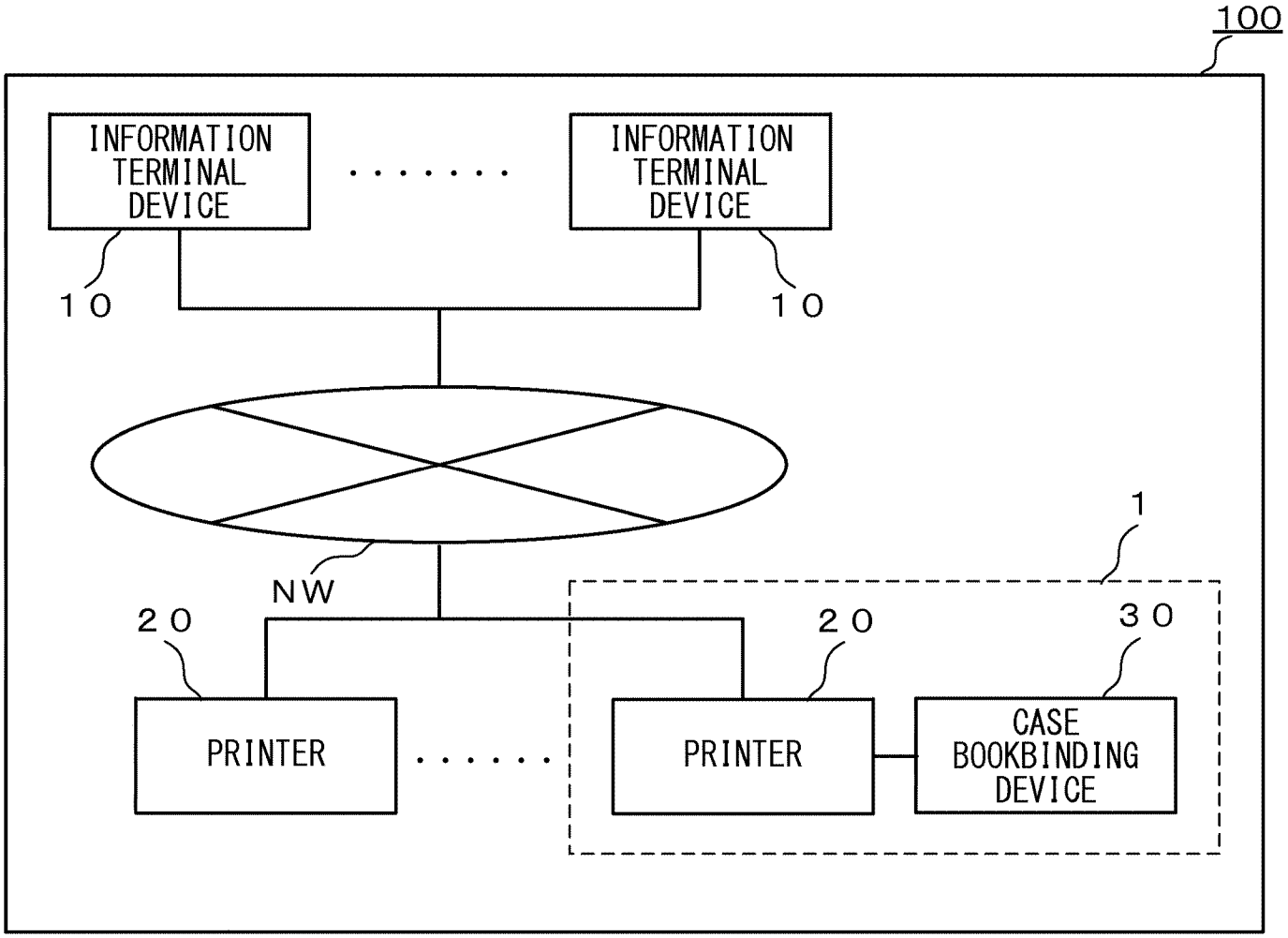
FIG. 1 illustrates an exemplary configuration of a printing system according to an embodiment.

FIG. 1 illustrates an exemplary configuration of a printing system 100 according to the embodiment. As illustrated in FIG. 1, the printing system 100 includes one or a plurality of information terminal devices 10, one or a plurality of printers 20, and one or a plurality of case bookbinding devices 30, and the respective information terminal devices 10 and the respective printers 20 that configure the printing system 100 are communicably connected to each other via a network NW.

In addition, at least some of the printers 20 that configure the printing system 100 are printers 20 that correspond to a bookbinding function. The printer 20 that corresponds to the bookbinding function is coupled to the case bookbinding device 30, and configures a bookbinding system 1, as illustrated in FIG. 1. The bookbinding system 1 according to the embodiment enables a booklet B to be manufactured on the basis of a cover paper sheet P1 and body text paper sheets P2 that are printed in the printer 20 by coupling the case bookbinding device 30 to the printer 20 that corresponds to the bookbinding function.

The description below is given under the assumption that the printer 20 that configures the bookbinding system 1 receives a print job that is generated by setting a case bookbinding print setting illustrated in FIG. 2 by a user of the information terminal device 10 that configures the printing system 100. The description below is also given under the assumption that the number of manufactured booklets B is one. Here, FIG. 2 illustrates an example of a case bookbinding print setting screen according to the embodiment.

Figure 2:
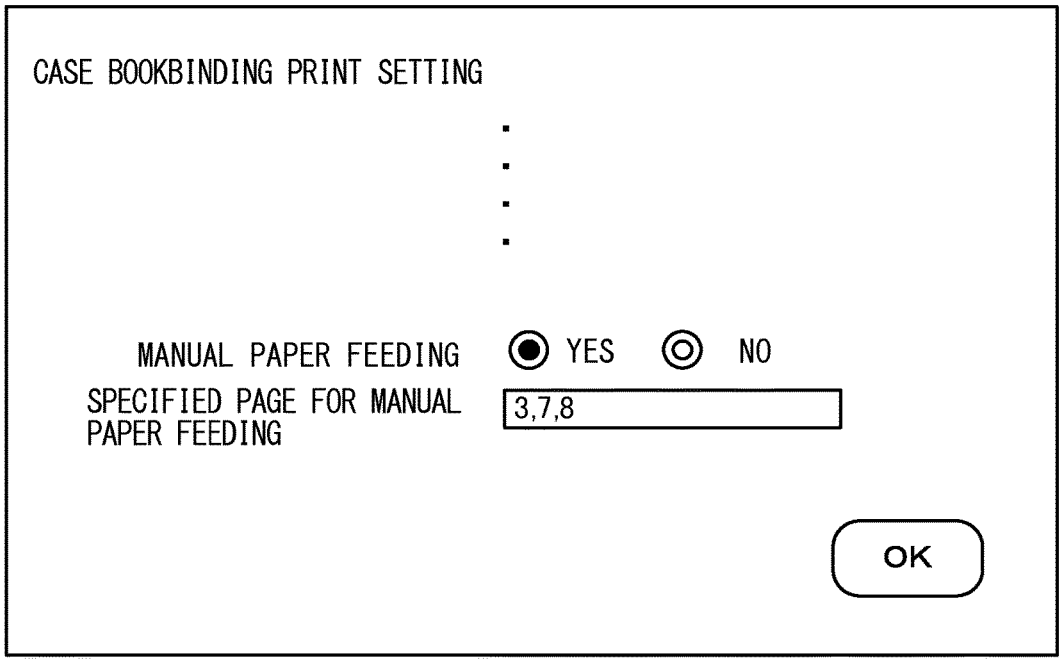
FIG. 2 illustrates an example of a case bookbinding print setting screen according to the embodiment.

A case bookbinding print setting according to the embodiment includes setting items "manual paper feeding" and "specified page for manual paper feeding", as illustrated in FIG. 2. When "YES" is selected in "manual paper feeding", a medium (paper bundle) TG, such as a catalog, that is formed of a plurality of paper sheets can be manually fed, and can be inserted as a portion of a body text of a booklet B. "Specified page for manual paper feeding" specifies a page immediately after an inserted position of the manually fed medium (paper bundle) TG, and can be set when "manual paper feeding" is set to be "YES". "Specified page for manual paper feeding" may specify a page immediately before the inserted position of the manually fed medium (paper bundle) TG.

As an example, with reference to FIG. 2, a case in which "specified page for manual paper feeding" indicates "3", "7", and "8" shows that a user desires the insertion of media (paper bundles) TG to be manually fed immediately before the third, seventh, and eighth pages of a body text portion. When a medium (paper bundle) TG to be manually fed is desired to be inserted after the last body text paper sheet, a manual paper feeding process is performed by inputting, for example, X1, X2, . . . in the column "specified page for manual paper feeding". Here, "k" of Xk expresses a number of an object to be manually fed that is inserted after the last body text paper sheet.

Figure 3:
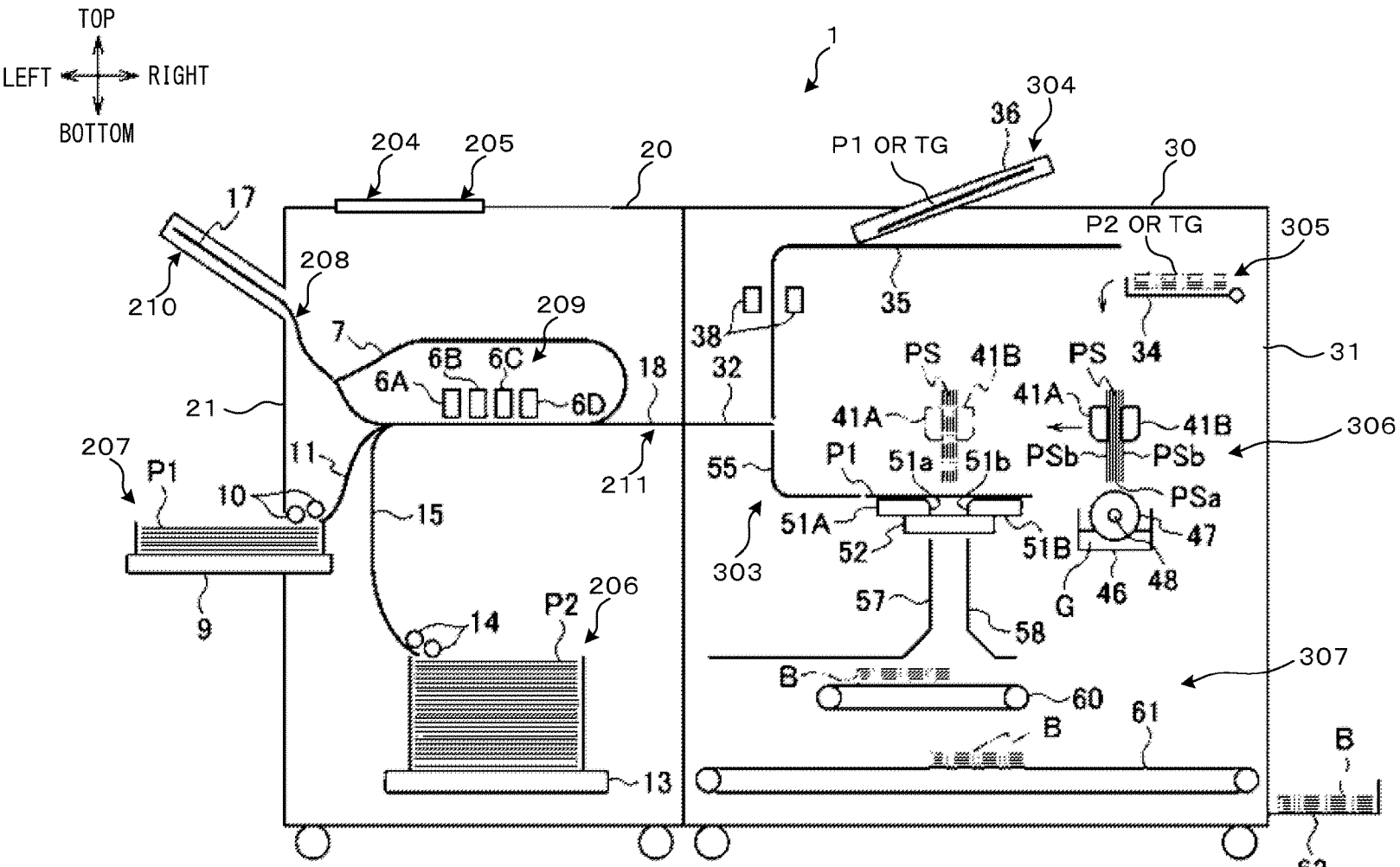
FIG. 3 is a schematic diagram of a physical configuration of a bookbinding system according to the embodiment.
Figure 4:
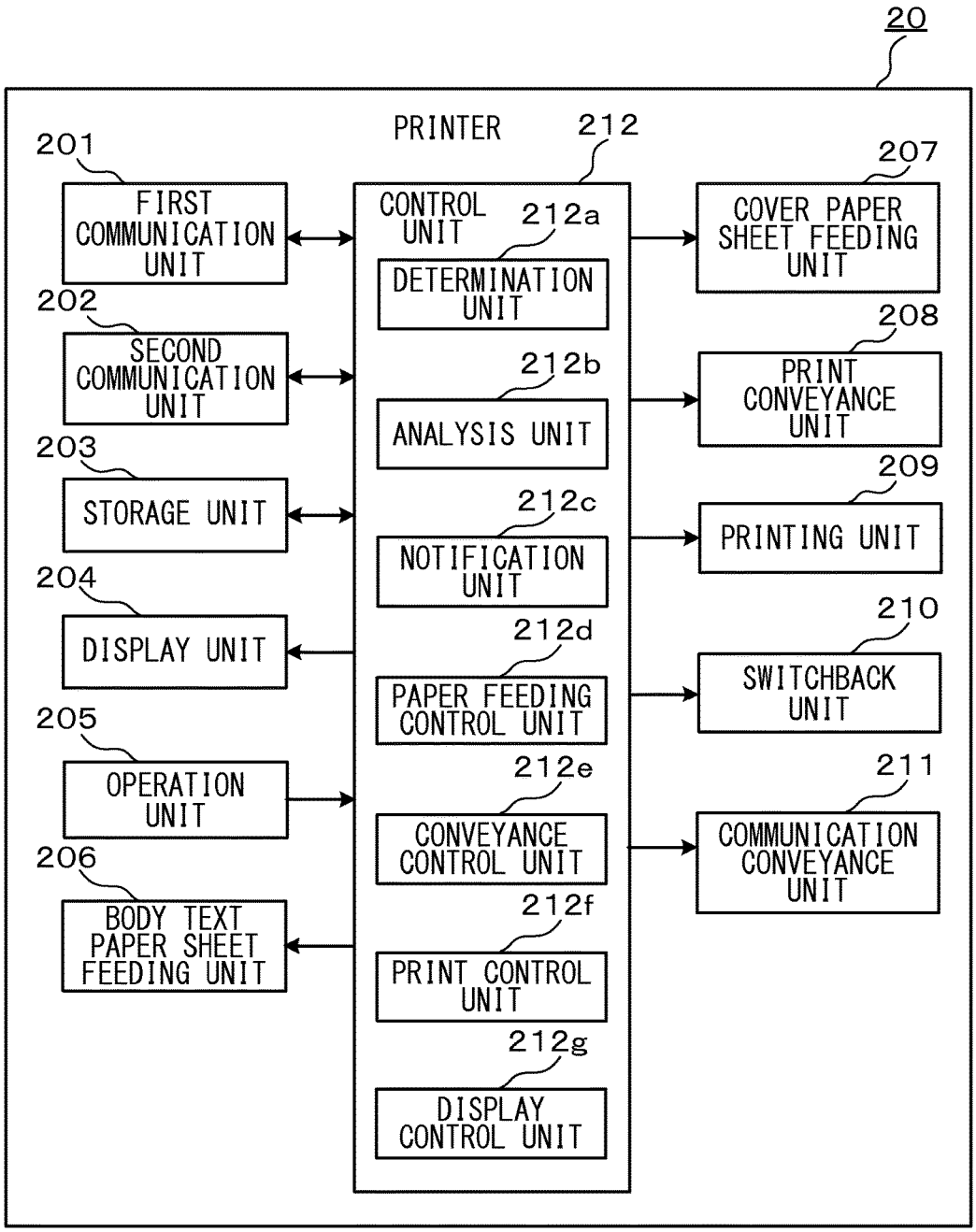
FIG. 4 is a functional block diagram illustrating an exemplary configuration of a printer that configures the bookbinding system according to the embodiment.
Figure 5:
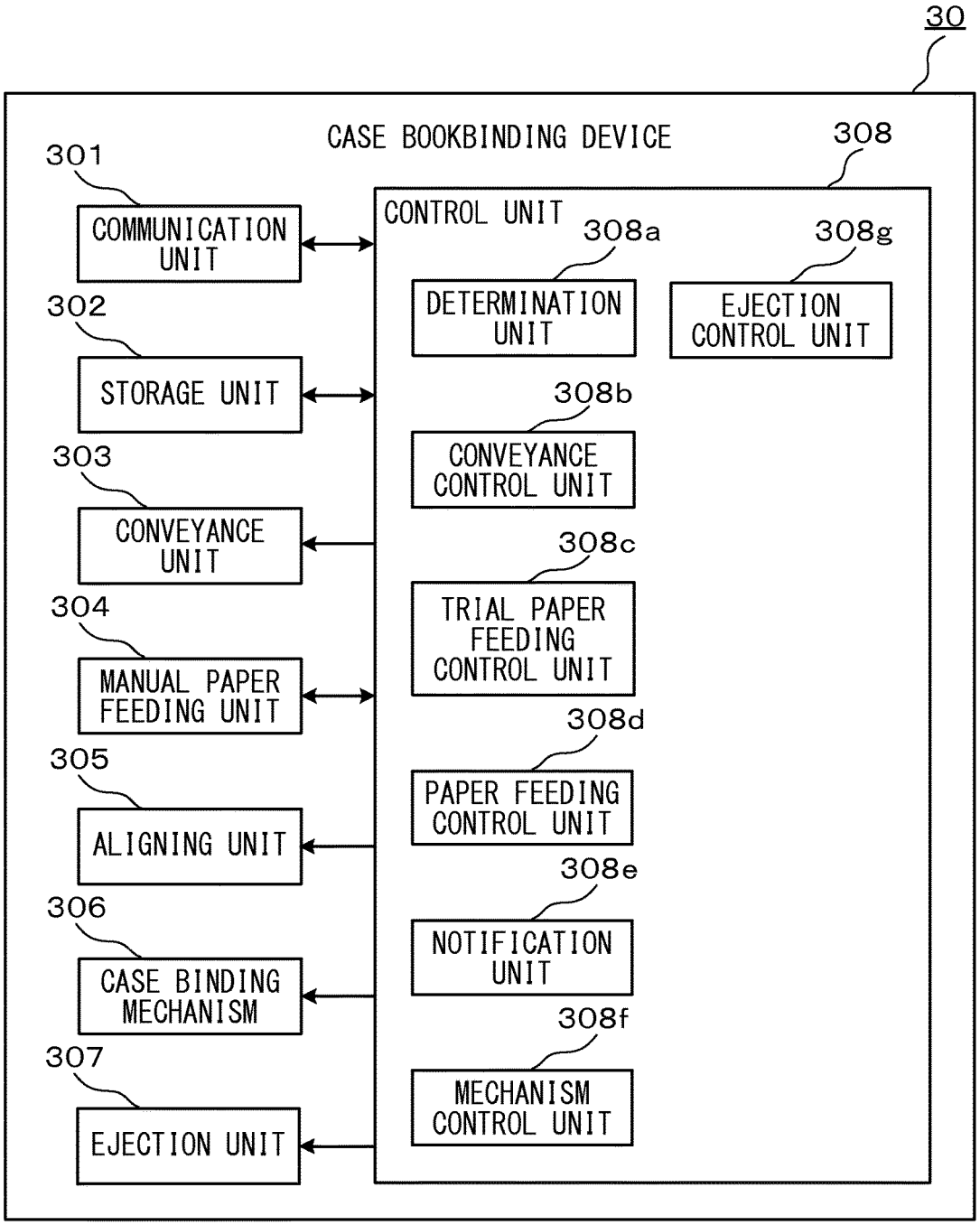
FIG. 5 is a functional block diagram illustrating an exemplary configuration of a case bookbinding device that configures the bookbinding system according to the embodiment.

With reference to FIG. 3 to FIG. 5, the bookbinding system 1 according to the embodiment is described in more detail. FIG. 3 is a schematic diagram of a physical configuration of the bookbinding system 1 according to the embodiment. FIG. 4 is a functional block diagram illustrating an exemplary configuration of the printer 20 that configures the bookbinding system 1 according to the embodiment. FIG. 5 is a functional block diagram illustrating an exemplary configuration of the case bookbinding device 30 that configures the bookbinding system 1 according to the embodiment.

In the description below, it is assumed that a user is located in a paper surface direction in FIG. 3, and that the left, right, top, and bottom when viewed from the user are leftward, rightward, upward, and downward directions, as illustrated in FIG. 3. In FIG. 3, among function units in the printer 20 illustrated in FIG. 4, a first communication unit 201, a second communication unit 202, a storage unit 203, and a control unit 212 are not illustrated, and among function units in the case bookbinding device 30 illustrated in FIG. 5, a communication unit 301, a storage unit 302, and a control unit 308 are not illustrated.

The printer 20 includes a housing 21, as illustrated in FIG. 3, and is configured so as to include the first communication unit 201, the second communication unit 202, the storage unit 203, a display unit 204, an operation unit 205, a body text paper sheet feeding unit 206, a cover paper sheet feeding unit 207, a print conveyance unit 208, a printing unit 209, a switchback unit 210, a communication conveyance unit 211, and a control unit 212, as illustrated in FIG. 3 and FIG. 4.

The first communication unit 201 is configured of a communication module or the like, and communicates with a device, such as the information terminal device 10, that is connected via the network NW. As an example, the first communication unit 201 receives a print job output from the information terminal device 10.

The second communication unit 202 is configured of an interface or the like, and communicates with the coupled case bookbinding device 30. As an example, the second communication unit 202 receives various notifications (described later in detail) that are output from the case bookbinding device 30. As an example, the second communication unit 202 transmits various notifications (described later in detail) that are generated by a notification unit 212*c* (described later in detail) to the case bookbinding device 30.

The storage unit 203 is configured of a RAM (Random Access Memory), a ROM (Read Only Memory), a nonvolatile memory, or the like. The storage unit 203 functions as a work area of a CPU (Central Processing Unit) that configures the control unit 212, a program area that stores various programs such as an operation program for controlling the entirety of the printer 20, and a data area that stores various types of data such as template data of various instruction screens.

The display unit 204 is configured of a display device such as an LCD (Liquid Crystal Display) or an organic EL (Electro-Luminescence), or the like, and is provided in an upper portion of the housing 21. The display unit 204 displays various function buttons, various instruction screens, or the like on the display screen.

The operation unit 205 is configured of a ten-key, a touch panel displayed on the display screen, or the like, and is provided in an upper portion of the housing 21, as illustrated in FIG. 3. A user can make the printer 20 perform a desired process by operating the operation unit 205 so as to input an instruction to the printer 20.

The body text paper sheet feeding unit 206 feeds a body text paper sheet P2 to the printing unit 209, and is provided below the printing unit 209 in the housing 21, as illustrated in FIG. 3. The body text paper sheet feeding unit 206 includes a paper feeding tray 13 on which the body text paper sheets P2 are stacked, and a paper feeding roller 14 that feeds the body text paper sheets P2 stacked on the paper feeding tray 13 to the side of the printing unit 209. The body text paper sheet feeding unit 206 also includes a paper feeding conveyance path 15 that is provided between the paper feeding tray 13 and a print conveyance path 7, and a plurality of rollers (not illustrated) that are provided along the paper feeding conveyance path 15 and that convey the body text paper sheets P2 to the side of the printing unit 209.

The cover paper sheet feeding unit 207 feeds a cover paper sheet P1 to the printing unit 209, and is provided on the left-hand side of the housing 21, as illustrated in FIG. 3. The cover paper sheet feeding unit 207 includes a paper feeding tray 9 on which the cover paper sheets P1 are stacked, and a paper feeding roller 10 that feeds the cover paper sheets P1 stacked on the paper feeding tray 9 to the side of the printing unit 209. The cover paper sheet feeding unit 207 also includes a paper feeding conveyance path 11 that is provided between the paper feeding tray 9 and the print conveyance path 7, and a plurality of rollers (not illustrated) that are provided along the paper feeding conveyance path 11 and that convey the cover paper sheets P1 to the side of the printing unit 209.

A print conveyance unit 208 includes the print conveyance path 7 that conveys the body text paper sheets P2 (or the cover paper sheets P1) that are conveyed out by the body text paper sheet feeding unit 206 (or the cover paper sheet feeding unit 207). As illustrated in FIG. 3, the print conveyance path 7 is a loop-shaped conveyance path that is provided so as to surround the printing unit 209. The print conveyance unit 208 also includes a plurality of rollers (not illustrated) that are provided along the print conveyance path 7 and that convey the body text paper sheets P2 (or the cover paper sheets P1).

The printing unit 209 performs a printing process on the body text paper sheets P2 (or the cover paper sheets P1) on the basis of raster data generated by a print control unit 212*f* (described later in detail), and includes line-type inkjet heads 6A-6D that respectively eject ink of cyan (C), magenta (M), yellow (Y), and black (K).

The switchback unit 210 temporarily stores the body text paper sheet P2 (or the cover paper sheet P1), and is provided in a left-side upper portion of the print conveyance path 7, as illustrated in FIG. 3. The switchback unit 210 includes a switchback conveyance path 17 that is provided from a left-side portion of the housing 21 to the inside of the switchback unit 210, and the like, as illustrated in FIG. 3. The switchback conveyance path 17 is a path for inverting a front surface and a back surface of the body text paper sheet P2 (or the cover paper sheet P1) and for conveying the body text paper sheet P2 (or the cover paper sheet P1) to the side of the printing unit 209.

The communication conveyance unit 211 is provided in a right-side portion of the housing 21, as illustrated in FIG. 3, and includes a communication conveyance path 18 for conveying, to the case bookbinding device 30, the printed body text paper sheet P2 (or the printed cover paper sheet P1) that has been conveyed out from the print conveyance path 7 after being printed by the printing unit 209. The communication conveyance unit 211 also includes a plurality of rollers (not illustrated) that are provided along the communication conveyance path 18 and that convey the printed body text paper sheet P2 (or the printed cover paper sheet P1).

The control unit 212 is configured of a CPU or the like, and executes an operation program stored in the program area of the storage unit 203 so as to realize functions of a determination unit 212*a*, an analysis unit 212*b*, a notification unit 212*c*, a paper feeding control unit 212*d*, a conveyance control unit 212*e*, a print control unit 212*f*, and a display control unit 212*g*. In addition, the control unit 212 performs processes such as a control process for controlling the entirety of the printer 20 or a printing process described later in detail.

The determination unit 212*a* performs various determination processes. As an example, the determination unit 212*a* determines whether a print job has been received. The determination unit 212*a* also determines whether "manual paper feeding" is set to "YES", on the basis of an analysis result of the analysis unit 212*b*.

The determination unit 212*a* also determines whether manual paper feeding will be performed before the next body text paper sheet P2. More specifically, the determination unit 212*a* determines whether manual paper feeding will be performed before a body text paper sheet P2 to be processed next, on the basis of numbers of body text paper sheets P2 immediately after inserted media (paper bundles) TG to be manually fed, which are specified by the notification unit 212*c* and which each indicate an order number of body text paper sheet P2. In other words, when a body text paper sheet P2 to be processed next is a body text paper sheet P2 that corresponds to a specified number, the determination unit 212*a* determines that manual paper feeding will be performed. However, when it is determined that manual paper feeding will be performed before a body text paper sheet P2 to be processed next, but when all of the media (paper bundles) to be manually fed have already been manually fed, the determination unit 212*a* determines that manual paper feeding will not be performed.

The determination unit 212*a* also determines whether various notifications (instructions) transmitted from the case bookbinding device 30 have been received. The determination unit 212*a* also determines whether all of the body text paper sheets P2 have been processed. When the determination unit 212*a* determines that all of the body text paper sheets have been processed, the determination unit 212*a* further determines whether there is an unprocessed medium (paper bundle) TG to be manually fed. In other words, when a medium (paper bundle) TG to be manually fed that is inserted after the last body text paper sheet P2 has not been processed, the determination unit 212*a* determines that there is an unprocessed object to be manually fed.

The determination unit 212*a* also determines whether a medium (paper bundle) TG to be manually fed has been placed directly on a stack tray 34 of the case bookbinding device 30. More specifically, when a "Continue" button on a placement instruction screen (illustrated in FIG. 7A) that is displayed on a display screen of the display unit 204 is selected, the determination unit 212*a* determines that a medium (paper bundle) TG to be manually fed has been placed.

The determination unit 212*a* determines whether a medium (paper bundle) TG to be manually fed has been stored in a paper feeding tray 36 of the case bookbinding device 30. More specifically, when a "Continue" button on a storage instruction screen (illustrated in FIG. 7B) that is displayed on the display screen of the display unit 204 is selected, the determination unit 212*a* determines that a medium (paper bundle) TG to be manually fed has been stored.

The determination unit 212*a* also determines whether a medium (paper bundle) TG that cannot be automatically fed has been removed from the paper feeding tray 36 of the case bookbinding device 30. More specifically, when a "continue" button on a removal instruction screen (illustrated in FIG. 7C) that is displayed on a display screen of the display unit 204 is selected, the determination unit 212*a* determines that a medium (paper bundle) TG that cannot be automatically fed has been removed.

The analysis unit 212*b* analyzes a received print job, and specifies a setting content set by a user.

The notification unit 212*c* generates various notifications, and transmits the generated notifications to the case bookbinding device 30 via the second communication unit 202. As an example, upon receipt of a print job, the notification unit 212*c* generates a body text sheet number notification indicating the number of sheets in a body text portion (the necessary number of body text paper sheets P2). When the determination unit 212*a* determines that manual paper feeding has been specified, the notification unit 212*c* specifies what order numbers respective body text paper sheets P2 immediately after inserted media (paper bundles) TG to be manually fed have, on the basis of specified pages set in the case bookbinding print setting. The notification unit 212*c* then generates a body text sheet number notification including insertion position information that associates a specified number with each of the specified pages. When a specified page specifies that a medium (paper bundle) TG to be manually fed is to be inserted after the last body text paper sheet P2, the notification unit 212*c* includes the specified page Xk in the insertion position information.

Figure 6A:
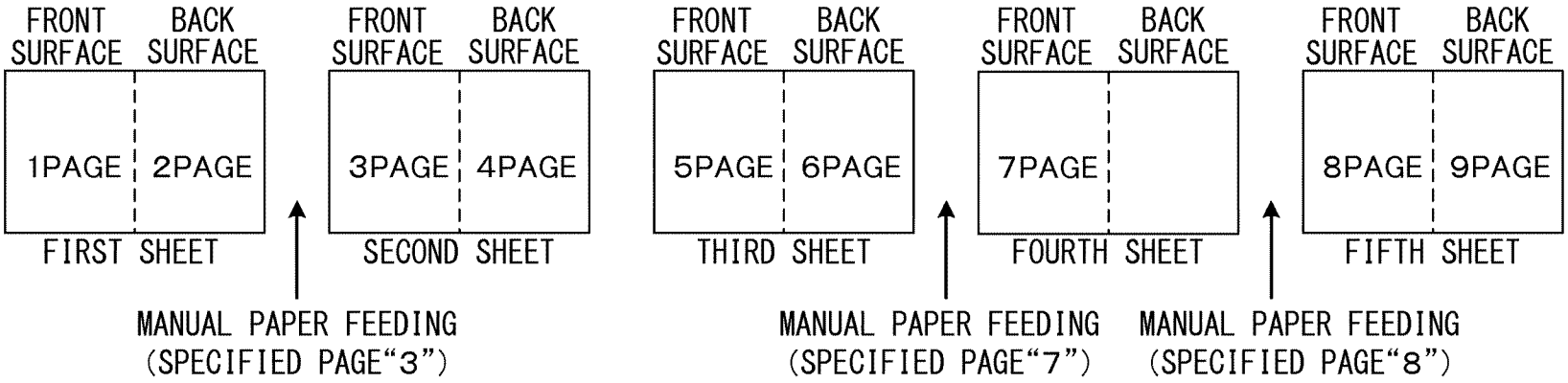
FIG. 6A is a diagram explaining an insertion position of an object to be manually fed.

As an example, with reference to FIG. 6A, when the number of pages in a body text portion on which a printing process is performed by the printing unit 209 is 9, and when specified pages are "3", "7", and "8", the notification unit 212*c* specifies that body text paper sheets P2 immediately after inserted media (paper bundles) TG to be manually fed are the second sheet, the fourth sheet, and the fifth sheet, as illustrated in FIG. 6A. As illustrated by the fourth body text paper sheet P2, when the eighth page is printed on a back surface of the fourth sheet, a medium (paper bundle) TG to be manually fed cannot be inserted immediately before the eighth page, and therefore the print control unit 212*f* allocates a blank page to the back surface of the fourth sheet, and allocates the eight page and the ninth page to the fifth sheet.

Figure 6B:
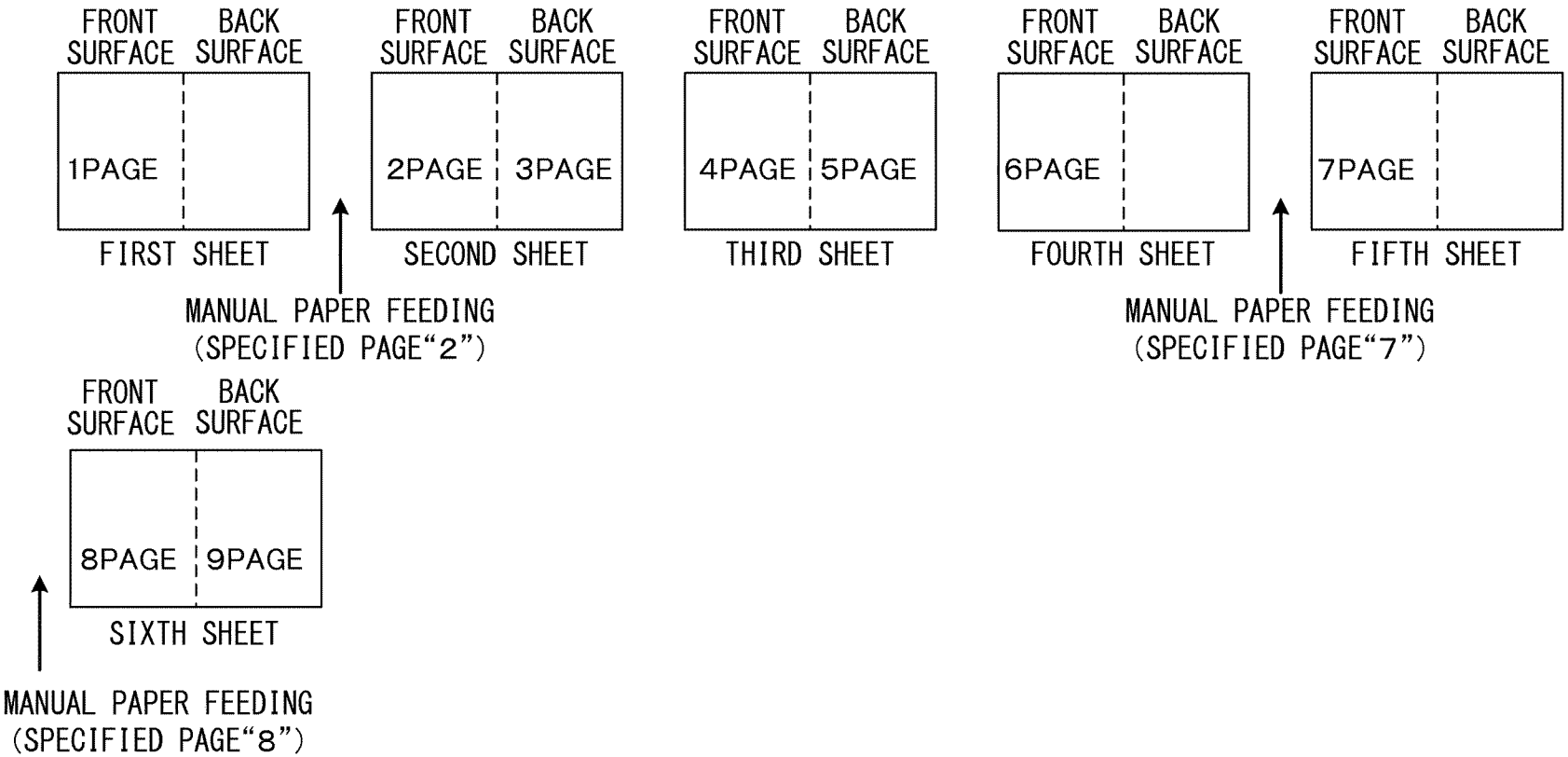
FIG. 6B is a diagram explaining an insertion position of an object to be manually fed.

As another example, with reference to FIG. 6B, when the number of pages in a body text portion on which a printing process is performed by the printing unit 209 is 9, and when specified pages are "2", "7", and "8", the notification unit 212*c* specifies that body text paper sheets P2 immediately after inserted media (paper bundles) TG to be manually fed are respectively the second sheet, the fifth sheet, and the sixth sheet, as illustrated in FIG. 6B. As illustrated by the first body text paper sheet P2, when the second page is printed on a back surface of the first sheet, a medium (paper bundle) TG to be manually fed cannot be inserted immediately before the second page, and therefore the print control unit 212*f* allocates a blank page to the back surface of the first sheet, and allocates the second page and the third page to the second sheet.

As illustrated by the fourth body text paper sheet P2, when the seventh page is printed on a back surface of the fourth sheet, a medium (paper bundle) TG to be manually fed cannot be inserted immediately before the seventh page, and therefore the print control unit 212*f* allocates a blank page to the back surface of the fourth sheet, and allocates the seventh page to a front surface of the fifth sheet. As illustrated by the fifth body text paper sheet P2, when the eighth page is printed on a back surface of the fifth sheet, a medium (paper bundle) TG to be manually fed cannot be inserted immediately before the eighth page, and therefore the print control unit 212*f* allocates a blank page to the back surface of the fifth sheet, and allocates the eighth page and the ninth page to the sixth sheet. Namely, when manual paper feeding has been specified, the necessary number of body text paper sheets P2 varies depending on set specified pages. Therefore, the notification unit 212*c* generates a body text sheet number notification in consideration of this point. Here, both FIG. 6A and FIG. 6B are diagrams explaining an insertion position of an object to be manually fed.

When the determination unit 212*a* determines that a medium (paper bundle) TG to be manually fed has been placed directly on the stack tray 34 of the case bookbinding device 30, the notification unit 212*c* generates a placement completion notification indicating that the medium (paper bundle) TG has been placed directly on the stack tray 34.

When the determination unit 212*a* determines that a medium (paper bundle) TG to be manually fed has been stored in the paper feeding tray 36 of the case bookbinding device 30, the notification unit 212*c* generates a storage completion notification indicating that the medium (paper bundle) TG has been stored in the paper feeding tray 36.

When the determination unit 212*a* determines that a medium (paper bundle) TG that cannot be automatically fed has been removed from the paper feeding tray 36 of the case bookbinding device 30, the notification unit 212*c* generates a removal completion notification indicating that the medium (paper bundle) TG that cannot be automatically fed has been removed from the paper feeding tray 36.

The paper feeding control unit 212*d* controls the body text paper sheet feeding unit 206 (or the cover paper sheet feeding unit 207) so as to convey out stacked body text paper sheets P2 (or cover paper sheets P1) one at a time from the paper feeding tray 13 (or the paper feeding tray 9). The paper feeding control unit 212*d* conveys the conveyed-out body text paper sheet P2 (or the cover paper sheet P1) to the side of the printing unit 209 via the paper feeding conveyance path 15 (or the paper feeding conveyance path 11).

The conveyance control unit 212*e* controls the print conveyance unit 208, the switchback unit 210, and the communication conveyance unit 211 so as to convey the body text paper sheet P2 (or the cover paper sheet P1) that has been conveyed out from the body text paper sheet feeding unit 206 (or the cover paper sheet feeding unit 207) to the printing unit 209 and to convey the body text paper sheet P2 (or the cover paper sheet P1) on which a printing process has been performed to the case bookbinding device 30.

The print control unit 212*f* controls the printing unit 209 so as to perform a printing process on a body text paper sheet P2 (or a cover paper sheet P1) on the basis of a received print job. More specifically, the print control unit 212*f* performs page allocation on the basis of the received print job, and then generates raster data. When manual paper feeding has been specified, the print control unit 212*f* performs page allocation in consideration of a specified page of a medium (paper bundle) TG to be manually fed, as described with reference to FIG. 6A and FIG. 6B. Namely, when a specified page of a medium (paper bundle) to be manually fed is a page which is allocated to a back surface of a body text paper sheet P2, the print control unit 212*f* enables the specified page to be allocated to a front surface of the body text paper sheet P2 by allocating a blank page to the back surface.

The print control unit 212*f* controls the printing unit 209 so as to perform a printing process on the body text paper sheet P2 (or the cover paper sheet P1) on the basis of the generated raster data.

The display control unit 212*g* controls the display unit 204 so as to display various instruction screens on the display screen. As an example, upon receipt of a placement instruction transmitted from the case bookbinding device 30, the display control unit 212*g* generates a placement instruction screen illustrated in FIG. 7A on the basis of template data of a placement instruction screen stored in the data area of the storage unit 203 and page information included in the placement instruction, and makes the generated placement instruction screen be displayed on the display screen. Note that the placement instruction screen illustrated in FIG. 7A is an example in a case in which a page that is indicated by page information included in a placement instruction is "seventh page".

Upon receipt of a storage instruction transmitted from the case bookbinding device 30, the display control unit 212*g* generates a storage instruction screen illustrated in FIG. 7B on the basis of template data of a storage instruction screen stored in the data area of the storage unit 203, and makes the generated storage instruction screen be displayed on the display screen.

Upon receipt of a removal instruction transmitted from the case bookbinding device 30, the display control unit 212*g* generates a removal instruction screen illustrated in FIG. 7C on the basis of template data of a removal instruction screen stored in the data area of the storage unit 203, and makes the generated removal instruction screen be displayed on the display screen.

Here, FIG. 7A illustrates an example of a placement instruction screen according to the embodiment. FIG. 7B illustrates an example of a storage instruction screen according to the embodiment. FIG. 7C illustrates an example of a removal instruction screen according to the embodiment.

Now return to FIG. 3 and FIG. 5. The case bookbinding device 30 performs a bookbinding process on printing paper sheets (cover paper sheets P1 and body text paper sheets P2) that have been printed by the printer 20 so as to manufacture a booklet B. In the embodiment, the case bookbinding device 30 is configured such that a portion of a body text of the booklet B can be manually fed.

The case bookbinding device 30 includes a housing 31, as illustrated in FIG. 3, and is configured so as to include a communication unit 301, a storage unit 302, a conveyance unit 303, a manual paper feeding unit 304, an aligning unit 305, a case binding mechanism 306, an ejection unit 307, and a control unit 308, as illustrated in FIG. 3 and FIG. 5.

The communication unit 301 is configured of an interface or the like, and communicates with the coupled printer 20. As an example, the communication unit 301 receives various notifications such as a placement completion notification transmitted from the coupled printer 20. As another example, the communication unit 301 transmits various notifications (described later in detail) that are generated by a notification unit 308*e* (described later in detail).

The storage unit 302 is configured of a RAM, a ROM, or the like. The storage unit 302 functions as a work area of a CPU that configures the control unit 308, a program area in which various programs such as an operation program for controlling the entirety of the case bookbinding device 30 is stored, and a data area in which various types of data such as an automatic paper-feeding-propriety management table T1 described later in detail is stored.

With reference to FIG. 8, an automatic paper-feeding-propriety management table T1 according to the embodiment is described below. FIG. 8 illustrates an exemplary configuration of the automatic paper-feeding-propriety management table T1 according to the embodiment. The automatic paper-feeding-propriety management table T1 is a table that manages an insertion position of a medium (paper bundle) TG to be manually fed and a result of trial paper feeding (described later in detail) (automatic paper feeding propriety) for each of the media (paper bundles) TG to be manually fed.

The automatic paper-feeding-propriety management table T1 is managed by a trial paper feeding control unit 308*c* (described later in detail), and is a table in which an "insertion position" and a "flag" are associated for each of the "specified pages", as illustrated in FIG. 8.

The "specified page" corresponds to a "specified page for manual paper feeding" that is set by a user in the case bookbinding print setting, and is registered by the trial paper feeding control unit 308*c* on the basis of insertion position information included in a received body text sheet number notification.

The "insertion position" indicates what order number of body text paper sheet P2 a corresponding "specified page" is allocated to, and is registered by the trial paper feeding control unit 308*c* on the basis of the insertion position information included in the received body text sheet number notification.

The "flag" is a flag indicating whether a corresponding medium (paper bundle) TG to be manually fed can be manually fed, and is set by the trial paper feeding control unit 308*c*. In the embodiment, a flag value "0" indicates that a corresponding medium (paper bundle) TG to be manually fed cannot be manually fed, and a flag value "1" indicates that a corresponding medium (paper bundle) TG to be manually fed can be automatically fed.

Now return to FIG. 3 and FIG. 5. The conveyance unit 303 includes an introduction conveyance path 32 for conveying, to an upper bookbinding conveyance path 35, a printed body text paper sheet P2 (or cover paper sheet P1) that is conveyed out from the communication conveyance path 18 of the printer 20. The conveyance unit 303 also includes a plurality of rollers (not illustrated) that are provided along the introduction conveyance path 32 and that convey the body text paper sheet P2 (or cover paper sheet P1).

The conveyance unit 303 also includes the upper bookbinding conveyance path 35 that is provided in an upper portion within the housing 31 and that conveys, to the aligning unit 305 (or the manual paper feeding unit 304), the printed body text paper sheet P2 (or cover paper sheet P1) that is conveyed out from the introduction conveyance path 32. The conveyance unit 303 further includes a plurality of rollers (not illustrated) that are provided along the upper bookbinding conveyance path 35 and that convey the body text paper sheet P2 (or the cover paper sheet P1). Among the plurality of rollers, a plurality of rollers that are provided along the upper bookbinding conveyance path 35 on a left-hand side of the paper feeding tray 36 can invert a conveyance direction of the printed cover paper sheet P1, and can convey the printed cover paper sheet P1 to the side of a lower bookbinding conveyance path 55.

The conveyance unit 303 also includes a lower bookbinding conveyance path 55 that is provided below the upper bookbinding conveyance path 35 in the housing 31. The lower bookbinding conveyance path 55 is a conveyance path for conveying, to a prescribed position, a printed cover paper sheet P1 that is conveyed out from the upper bookbinding conveyance path 35, in order to bend the printed cover paper sheet P1 along a spine surface PSa of a paper bundle of a body text portion (hereinafter referred to as a "body text paper bundle"). The conveyance unit 303 further includes a plurality of rollers (not illustrated) that are arranged along the lower bookbinding conveyance path 55 and that convey the cover paper sheet P1 to a prescribed position.

Figure 9:
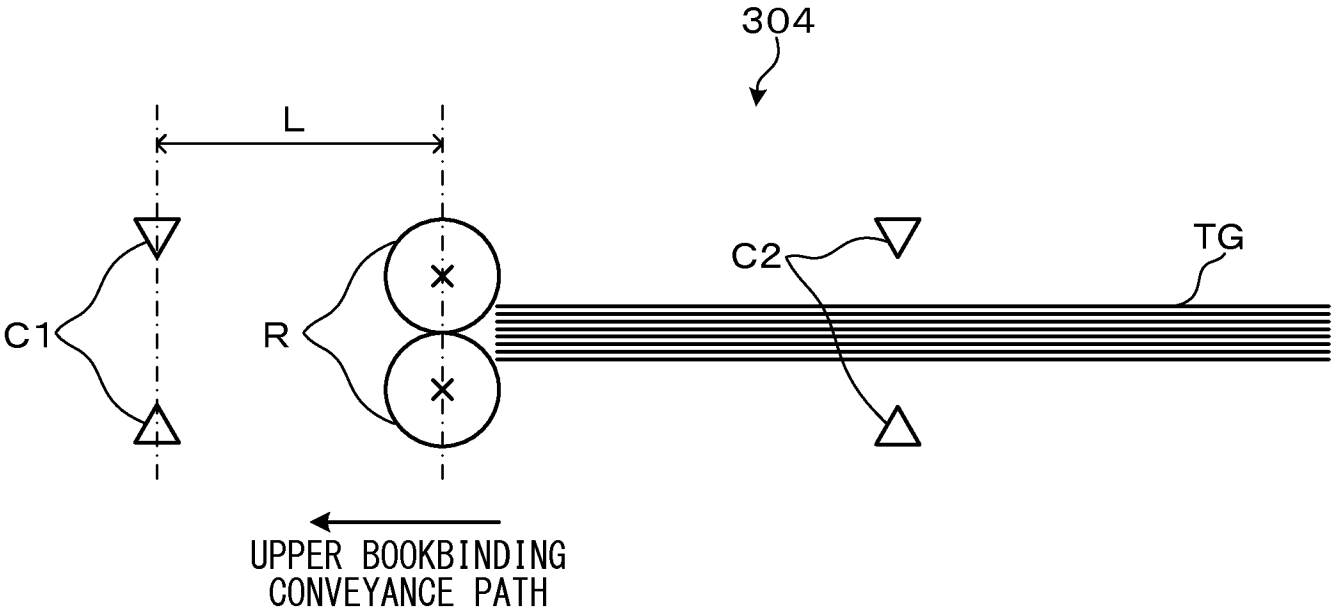
FIG. 9 is a diagram explaining a manual paper feeding unit according to the embodiment.

The manual paper feeding unit 304 is provided at an upper center of the housing 31, and includes the paper feeding tray 36 in which a medium (paper bundle) TG to be manually fed is stored. The paper feeding tray 36 also has a function of temporarily making a printed cover paper sheet P1 wait. As illustrated in FIG. 9, the manual paper feeding unit 304 also includes a conveying-out roller R that conveys out a stored medium (paper bundle) TG to be manually fed from the paper feeding tray 36 and that conveys the medium (paper bundle) TG to a side of the upper bookbinding conveyance path 35, a motor (not illustrated; also referred to as a "driving unit") that drives the conveying-out roller R, and the like. The motor that drives the conveying-out roller R is, for example, a stepping motor. Here, FIG. 9 is a diagram explaining the manual paper feeding unit 304 according to the embodiment. The manual paper feeding unit 304 is also referred to as a "storage unit".

The manual paper feeding unit 304 includes a medium detection sensor C1 that is provided in a position that is a prescribed distance L (mm) away from the center of the conveying-out roller R to a side of the upper bookbinding conveyance path 35, as illustrated in FIG. 9. The medium detection sensor C1 is a sensor that determines whether a medium (paper bundle) TG stored in the paper feeding tray 36 can be automatically fed when the medium (paper bundle) TG is fed as a trial, and is, for example, a transmissive sensor, a reflective sensor, or the like. The manual paper feeding unit 304 also includes a storage detection sensor C2 inside the paper feeding tray 36, as illustrated in FIG. 9. The storage detection sensor C2 is a sensor that determines whether a medium has been stored in the paper feeding tray 36, and is, for example, a microswitch, a transmissive sensor, or the like. As the prescribed distance L (mm) increases, a prescribed time period TM (described later in detail) also increases, and therefore it is preferable that the prescribed distance L (mm) be small. This is because in a case in which a thickness of a medium (paper bundle) TG fed as atrial exceeds an allowable value for conveying-out, when the prescribed time period TM (s) is great, a scraping due to the conveying-out roller R becomes great.

Now return to FIG. 3 and FIG. 5. The aligning unit 305 is provided at a right-side upper portion in the housing 31, and includes a stack tray 34 that aligns printed body text paper sheets P2 and a printed medium (paper bundle) TG to be manually fed so as to form a body text paper bundle PS. The aligning unit 305 is also referred to as a "storing unit". The stack tray 34 can convey out the body text paper bundle PS to the case binding mechanism 306, for example, by being rotated around the horizontal axis. A cover (hereinafter referred to as an "upper surface cover") (not illustrated) is provided on an upper surface of the housing 31, and a medium (paper bundle) TG can be placed directly on the stack tray 34 by opening the upper surface cover (also referred to as a "manual-storing permission unit").

The case binding mechanism 306 is a mechanism that manufactures a booklet B by applying an adhesive G to a spine surface PSa and portions of side surfaces PSb of the body text paper bundle PS that has been formed in the aligning unit 305, and by bending a printed cover paper sheet P1 that is conveyed out from the manual paper feeding unit 304 along the body text paper bundle PS to which the adhesive G has been applied, and is provided in a center portion in the housing 31.

More specifically, the case binding mechanism 306 includes a pair of clampers 41A and 41B that are movable while holding the body text paper bundle PS, and various motors (not illustrated) that open and close and move vertically and horizontally the pair of clampers 41A and 41B, as illustrated in FIG. 3. The case binding mechanism 306 also includes an adhesive storage tray 46 that is provided below the stack tray 34 and that stores the adhesive G. In the adhesive storage tray 46, an applying roller 47 is provided that applies the adhesive G to the spine surface PSa and portions of the side surfaces PSb of the body text paper bundle PS. The applying roller 47 is rotatably supported by a rotation axis 48 inside the adhesive storage tray 46.

Further, the case binding mechanism 306 includes a pair of spine bending plates 51A and 51B and an abutting plate 52 provided on a lower side of the spine bending plates 51A and 51B. The spine bending plates 51A and 51B are horizontally movable on the abutting plate 52 so as to approach or separate from each other. The spine bending plates 51A and 51B have pressing surfaces 51*a* and 51*b* facing each other, as illustrated in FIG. 3. The pressing surfaces 51*a* and 51*b* are vertical surfaces that are substantially orthogonal to an upper surface of the substantially horizontal abutting plate 52. The abutting plate 52 is horizontally movable. The pressing surfaces 51*a* and 51*b* of the spine bending plates 51A and 51B press a body text paper bundle PS from left-hand and right-hand sides via a cover paper sheet P1 in a state in which the spine surface PSa of the body text paper bundle PS to which the adhesive G has been applied is abutting on the abutting plate 52 via the cover paper sheet P1 such that the cover paper sheet P1 is bent.

The ejection unit 307 ejects a booklet B manufactured by the case binding mechanism 306 to the outside of the housing 31, and is provided below guide members 57 and 58, as illustrated in FIG. 3. The ejection unit 307 includes a conveying conveyor 60 that receives the booklet B that falls from the case binding mechanism 306, that conveys the booklet B to a left-hand side, and that makes the booklet B fall downward, and an ejecting conveyor 61 that is provided below the conveying conveyor 60. The ejecting conveyor 61 receives the booklet B that falls from the conveying conveyor 60, conveys the booklet B to a right-hand side, and ejects the booklet B to the outside of the housing 31. The ejection unit 307 also includes a receiving stand 62 that is provided on a downstream side of the ejecting conveyor 61 and that receives the booklet B ejected from the ejecting conveyor 61.

The control unit 308 is configured of a CPU or the like, and executes an operation program stored in the program area of the storage unit 302 so as to realize functions of a determination unit 308*a*, a conveyance control unit 308*b*, atrial paper feeding control unit 308*c*, a paper feeding control unit 308*d*, a notification unit 308*e*, a mechanism control unit 308*f*, and an ejection control unit 308*g*, as illustrated in FIG. 5. In addition, the control unit 308 performs processes such as a control process for controlling the entirety of the case bookbinding device 30 or a trial paper feeding process described later in detail.

The determination unit 308*a* performs various determination processes. As an example, the determination unit 308*a* determines whether various notifications transmitted from the coupled printer 20 have been received. Upon receipt of a body text sheet number notification, the determination unit 308*a* determines whether there are specified pages on the basis of whether the body text sheet number notification includes insertion position information. More specifically, the determination unit 308*a* determines that there are specified pages when insertion position information is included, and determines that there are no specified pages when insertion position information is not included.

The determination unit 308*a* also determines whether a medium (paper bundle) TG to be manually fed has been stored in the paper feeding tray 36. More specifically, when the storage detection sensor C2 detects a medium, the determination unit 308*a* determines that a medium (paper bundle) TG to be manually fed has been stored in the paper feeding tray 36.

Further, the determination unit 308*a* determines whether a medium (paper bundle) TG to be manually fed that has been fed as a trial can be automatically fed. More specifically, when the medium detection sensor C1 detects a medium before a prescribed time period TM (s) has passed after the conveying-out roller R commences being driven under the control of the trial paper feeding control unit 308*c*, the determination unit 308*a* determines that the medium can be automatically fed. When the medium detection sensor C1 does not detect a medium, the determination unit 308*a* determines that the medium cannot be automatically fed. Assuming that an outer circumferential length (mm) of the conveying-out roller R [or a movement amount (mm) of a medium to be conveyed out per revolution of the conveying-out roller R] is Z and that the number of revolutions per second (rps) of the conveying-out roller R at the time of trial paper feeding is LS, a prescribed time period TM (s) is defined so as to satisfy $TM \geq L/(Z \times LS)$. In this expression, L is a prescribed distance L (mm) illustrated in FIG. 9.

In addition, the determination unit 308*a* determines whether a medium (paper bundle) TG for which it is determined that automatic paper feeding is available as a result of a trial paper feeding has been fed from the paper feeding tray 36 under the control of the paper feeding control unit 308*d*. The determination unit 308*a* also determines whether there are unprocessed specified pages. Namely, the determination unit 308*a* determines whether there are media (paper bundles) TG that have not been fed as a trial. More specifically, when trial paper feedings of the number of specified pages have been performed, the determination unit 308*a* determines that there are no unprocessed specified pages, and when trial paper feedings of the number of specified pages have not been performed, the determination unit 308*a* determines that there are unprocessed specified pages.

The determination unit 308*a* searches the column "insertion position" in the automatic paper-feeding-propriety management table T1, and determines whether manual paper feeding will be performed before a body text paper sheet P2 that is conveyed next from the printer 20. When manual paper feeding is performed before a body text paper sheet P2 that is conveyed next but when all of the media to be manually fed have been manually fed, the determination unit 308*a* determines that manual paper feeding will not be performed. As an example, with reference to FIG. 8, the "insertion position" is "3", "7", and "8". In this case, the determination unit 308*a* determines that manual paper feeding will be performed when a body text paper sheet P2 that is conveyed next is one of the third, seventh, and eighth sheets.

When the determination unit 308*a* determines that manual paper feeding will be performed, the determination unit 308*a* searches the column "flag" in the automatic paper-feeding-propriety management table T1, and determines whether a flag value that corresponds to a medium (paper bundle) TG to be manually fed is "1". The determination unit 308*a* also determines whether all of the body text paper sheets P2 have been conveyed to the stack tray 34. More specifically, when body text paper sheets P2 of the number of sheets indicated by a received body text sheet number notification have been conveyed to the stack tray 34, the determination unit 308*a* determines that all of the body text paper sheets P2 have been conveyed, and when the number of body text paper sheets P2 conveyed to the stack tray 34 does not reach the number of sheets indicated by a received body text sheet number notification, the determination unit 308*a* determines that all of the body text paper sheets P2 have not been conveyed.

When the determination unit 308*a* determines that all of the body text paper sheets P2 have been conveyed to the stack tray 34, the determination unit 308*a* further determines whether there are unprocessed media (paper bundles) TG to be manually fed. In other words, when there are media (paper bundles) TG to be manually fed that will be inserted after the last body text paper sheet P2 and when the media (paper bundles) TG are unprocessed, the determination unit 308*a* determines that there are unprocessed media to be manually fed.

The conveyance control unit 308*b* controls the conveyance unit 303 so as to convey a medium such as a printed body text paper sheet P2 to a prescribed position. As an example, the conveyance control unit 308*b* controls the conveyance unit 303 so as to convey a printed body text paper sheet P2 that is conveyed from the printer 20 to the stack tray 34. As another example, the conveyance control unit 308*b* controls the conveyance unit 303 so as to convey a medium (paper bundle) TG that is conveyed from the paper feeding tray 36 to the stack tray 34.

The trial paper feeding control unit 308*c* controls the manual paper feeding unit 304 so as to feed as a trial a medium (paper bundle) TG to be manually fed that has been stored in the paper feeding tray 36. Trial paper feeding is performed in order to determine that each of the media (paper bundles) TG to be manually fed that have been stored in the paper feeding tray 36 can be automatically fed. Therefore, trial paper feeding is performed prior to an actual paper feeding.

More specifically, the trial paper feeding control unit 308*c* controls a motor (not illustrated) that drives the conveying-out roller R so as to revolve the conveying-out roller Rat a speed lower than the speed in a usual paper feeding (the number of revolutions LS (rps)). Namely, assuming that the number of revolutions (rps) in a usual paper feeding is HS, HS>LS is established. When the medium detection sensor C1 detects a medium before a prescribed time period TM (s) has passed after the conveying-out roller R commences being driven, the trial paper feeding control unit 308*c* stops the driving of the conveying-out roller R at the time of detection. The trial paper feeding control unit 308*c* then makes the conveying-out roller R revolve in reverse so as to perform a process of returning a medium (paper bundle) TG that has been fed as a trial to the paper feeding tray 36.

When the medium detection sensor C1 does not detect a medium when a prescribed time period TM (s) has passed, the trial paper feeding control unit 308*c* stops the driving of the conveying-out roller R.

The trial paper feeding control unit 308*c* manages the automatic paper-feeding-propriety management table T. More specifically, when a received body text sheet number notification includes insertion position information, the trial paper feeding control unit 308*c* registers an entry of the automatic paper-feeding-propriety management table T1 on the basis of the insertion position information. When the insertion position information includes a specified page Xk, the trial paper feeding control unit 308*c* registers the column "insertion position" that corresponds to the specified page Xk so as to be blank. When it is determined that automatic paper feeding is available as a result of trial paper feeding, a flag value of a corresponding flag in the automatic paper-feeding-propriety management table T1 is set to "1", and when it is determined that automatic paper feeding is unavailable, a flag value of a corresponding flag is set to "0".

The paper feeding control unit 308*d* controls the manual paper feeding unit 304 so as to convey a medium (paper bundle) TG that it is determined that can be automatically fed from the paper feeding tray 36. At this point of time, the number of revolutions of the conveying-out roller R is controlled so as to be HS (rps). The paper feeding control unit 308*d* controls the manual paper feeding unit 304 so as to convey out a printed cover paper sheet P1 that is made to temporarily wait in the paper feeding tray 36.

The notification unit 308*e* generates various notifications, and transmits the generated notifications to the coupled printer 20 via the communication unit 301. As an example, when the determination unit 308*a* determines that no media (paper bundles) TG have been stored in the paper feeding tray 36, the notification unit 308*e* generates a storage instruction that instructs that a medium (paper bundle) TG to be manually fed be stored in the paper feeding tray 36. As another example, when the determination unit 308*a* determines that a medium (paper bundle) TG cannot be automatically fed as a result of trial paper feeding, the notification unit 308*e* generates a removal instruction that instructs that the medium (paper bundle) TG be removed from the paper feeding tray 36.

As another example, when the determination unit 308*a* determines that a flag value that corresponds to a medium (paper bundle) TG to be manually fed is "0", namely, when automatic paper feeding from the paper feeding tray 36 cannot be performed, the notification unit 308*e* generates a placement notification that instructs that a medium (paper bundle) TG to be manually fed be placed directly on the stack tray 34. The placement instruction includes page information indicating a specified page that corresponds to the medium (paper bundle) TG that is placed directly on the stack tray 34. As another example, when a medium (paper bundle) TG to be manually fed is conveyed from the paper feeding tray 36 and is conveyed to the stack tray 34, the notification unit 308*e* generates a paper feeding completion notification indicating that paper feeding is completed.

The mechanism control unit 308*f* controls the aligning unit 305 so as to feed a body text paper bundle PS from the aligning unit 305, and controls the case binding mechanism 306 so as to manufacture a booklet B on the basis of a cover paper sheet P1 fed from the paper feeding tray 36 and the body text paper bundle PS fed from the aligning unit 305. The mechanism control unit 308*f* controls the case binding mechanism 306 so as to make the manufactured booklet B fall to the ejection unit 307.

The ejection control unit 308*g* controls the ejection unit 307 so as to convey the booklet B that has fallen from the case binding mechanism 306 to the receiving stand 62 and to eject the manufactured booklet B to the outside of the housing 31.

Figure 10:
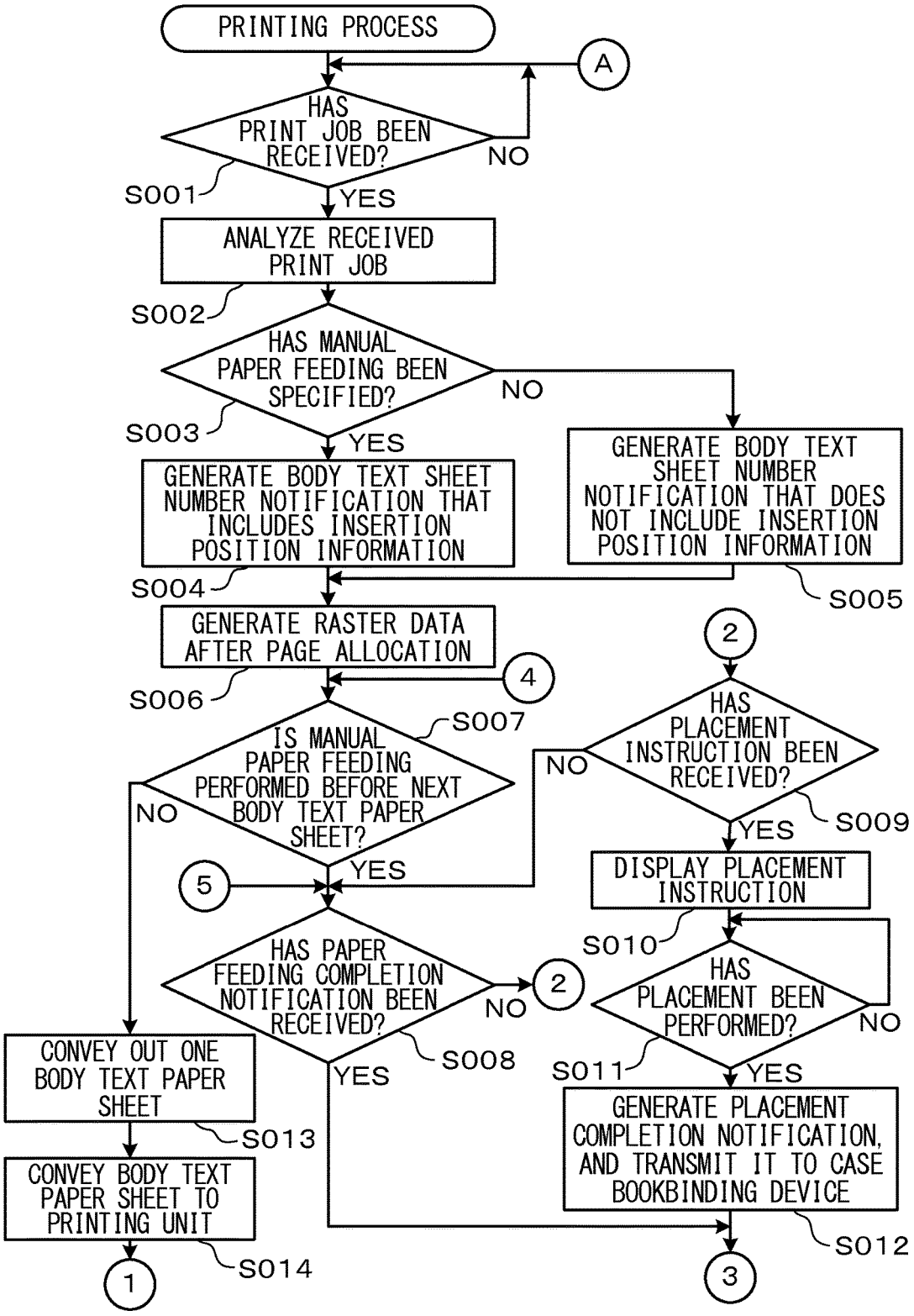
FIG. 10 is a portion of an example of a flowchart explaining a flow of a printing process according to the embodiment.
Figure 11:
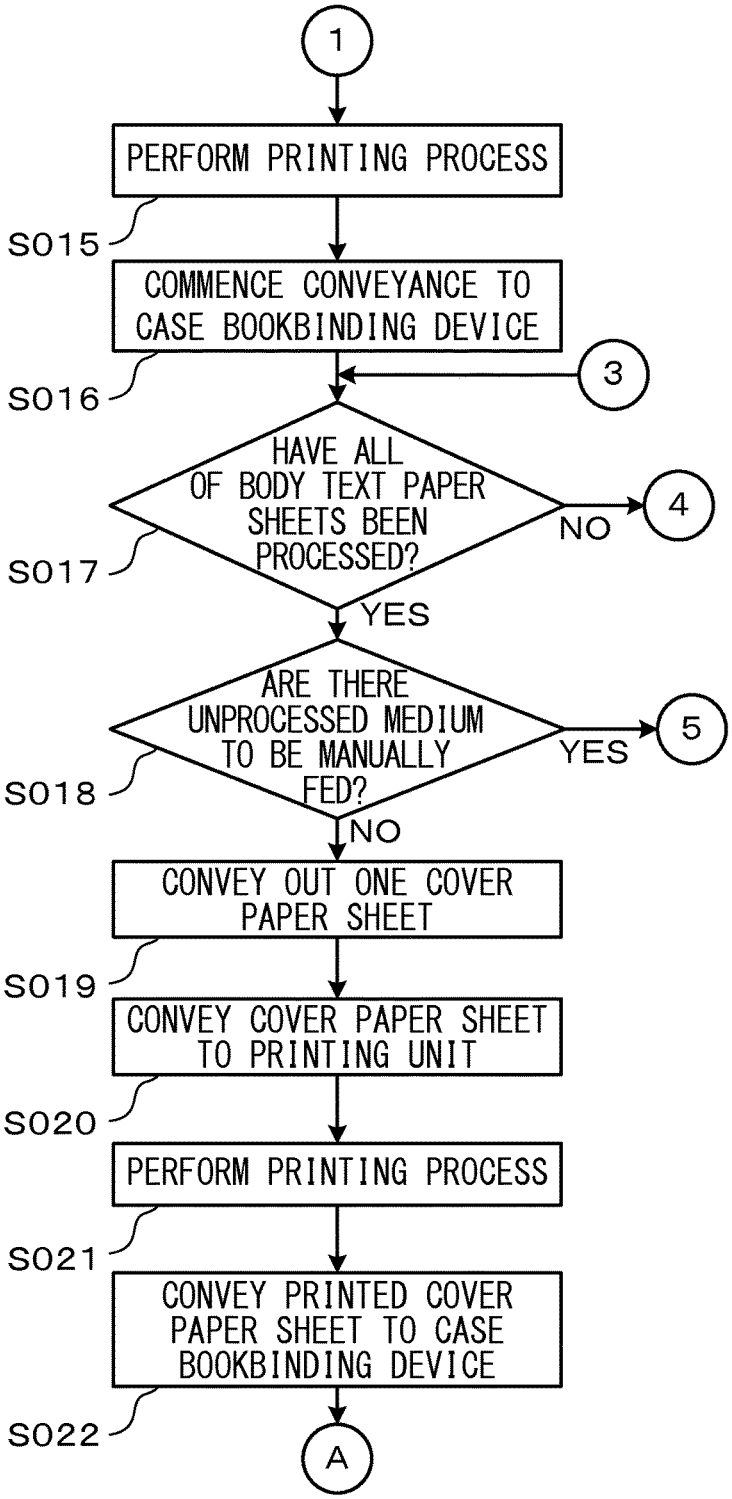
FIG. 11 is another portion of an example of a flowchart explaining a flow of a printing process according to the embodiment.

With reference to FIG. 10 and FIG. 11, a flow of a printing process according to the embodiment is described below. FIG. 10 and FIG. 11 are respective portions of an example of a flowchart explaining a flow of a printing process according to the embodiment. The printing process is performed in the side of the printer 20, and is commenced by using the reception of a print job as a trigger.

The determination unit 212*a* determines whether a print job has been received (step S001). When the determination unit 212*a* determines that a print job has not been received (step S001: NO), the process of step S001 is repeated, and the reception of a print job is awaited.

When the determination unit 212*a* determines that a print job has been received (step S001: YES), the analysis unit 212*b* analyzes the received print job, and specifies a setting content or the like (step S002). The determination unit 212*a* then determines whether the received print job includes the specification of manual paper feeding (step S003).

When the determination unit 212*a* determines that the received print job includes the specification of manual paper feeding (step S003: YES), the notification unit 212*c* generates a body text sheet number notification that includes insertion position information, and transmits the generated body text sheet number notification to the coupled case bookbinding device 30 via the second communication unit 202 (step S004). The process moves on to the process of step S006 described later.

When the determination unit 212*a* determines that the received print job does not include the specification of manual paper feeding (step S003: NO), the notification unit 212*c* generates a body text sheet number notification that does not include insertion position information, and transmits the generated body text sheet number notification to the coupled case bookbinding device 30 via the second communication unit 202 (step S005).

The print control unit 212*f* performs page allocation in consideration of a specified page of a medium (paper bundle) TG to be manually fed, and generates raster data (step S006). The determination unit 212*a* then determines whether manual paper feeding will be performed before a body text paper sheet P2 to be processed next (step S007). When manual paper feeding is performed before a body text paper sheet P2 to be processed next but when all of the media (paper bundles) TG to be manually fed have been manually fed, the determination unit 212*a* determines that manual paper feeding is not performed.

When it is determined that manual paper feeding will be performed (step S007: YES), the determination unit 212*a* further determines whether a paper feeding completion notification has been received (step S008). When the determination unit 212*a* determines that a paper feeding completion notification has been received (step S008: YES), the process moves on to the process of step S017.

When it is determined that a paper feeding completion notification has not been received (step S008: NO), the determination unit 212*a* further determines whether a placement instruction has been received (step S009). When the determination unit 212*a* determines that a placement instruction has not been received (step S009: NO), the process returns to the process of step S008, and the processes described above are repeated.

When the determination unit 212*a* determines that a placement instruction has been received (step S009: YES), the display control unit 212*g* generates a placement instruction screen illustrated in FIG. 7A on the basis of template data of the placement instruction screen stored in the data area of the storage unit 203 and page information included in the placement instruction, and controls the display unit 204 so as to display the generated placement instruction screen on the display screen (step S010). At this point of time, another notification means may be used simultaneously so as to notify a user that a placement instruction screen has been displayed.

The determination unit 212*a* determines whether a medium (paper bundle) TG has been placed directly on the stack tray 34 (step S011). When the determination unit 212*a* determines that a medium (paper bundle) TG has not been placed (step S011: NO), the process of step S011 is repeated so as to wait for the medium (paper bundle) TG to be placed directly on the stack tray 34 and for the "Continue" button on the placement instruction screen to be selected.

When the determination unit 212*a* determines that a medium (paper bundle) TG has been placed directly (step S011: YES), the notification unit 212*c* generates a placement completion notification, and transmits the generated placement completion notification to the coupled case bookbinding device 30 via the second communication unit 202 (step S012). The process moves on to the process of step S017 described later.

In the process of step S007, when the determination unit 212*a* determines that manual paper feeding will not be performed (step S007: NO), the paper feeding control unit 212*d* controls the body text paper sheet feeding unit 206 so as to convey one body text paper sheet P2 from the paper feeding tray 13 (step S013), and the paper feeding control unit 212*d* makes the conveyed-out body text paper sheet P2 be conveyed to the printing unit 209 in cooperation with the conveyance control unit 212*e* (step S014).

In cooperation with the conveyance control unit 212*e*, the print control unit 212*f* controls the printing unit 209 and the like so as to print the conveyed body text paper sheet P2 on the basis of the generated raster data (step S015). The conveyance control unit 212*e* then controls the communication conveyance unit 211 so as to commence the conveyance of the printed body text paper sheet P2 to the coupled case bookbinding device 30 (step S016).

The determination unit 212*a* determines whether all of the body text paper sheets P2 have been processed (step S017). When the determination unit 212*a* determines that not all of the body text paper sheets P2 have been processed (step S017: NO), the process returns to the process of step S007, and the processes described above are repeated.

When all of the body text paper sheets P2 have been processed (step S017: YES), the determination unit 212*a* further determines whether there are unprocessed media (paper bundles) TG to be manually fed (step S018). When the determination unit 212*a* determines that there are unprocessed media (paper bundles) TG to be manually fed (step S018: YES), the process returns to the process of step S008, and the processes described above are repeated.

When the determination unit 212*a* determines that there are no unprocessed media (paper bundles) TG to be manually fed (step S018: NO), the paper feeding control unit 212*d* controls the cover paper sheet feeding unit 207 so as to convey one body text paper sheet P1 from the paper feeding tray 9 (step S019), and the paper feeding control unit 212*d* makes the conveyed-out cover paper sheet P1 be conveyed to the printing unit 209 in cooperation with the conveyance control unit 212*e* (step S020).

In cooperation with the conveyance control unit 212*e*, the print control unit 212*f* controls the printing unit 209 and the like so as to print the conveyed cover paper sheet P1 on the basis of the generated raster data (step S021). The conveyance control unit 212*e* controls the communication conveyance unit 211 so as to convey the printed cover paper sheet P1 to the coupled case bookbinding device 30 (step S022). The process returns to the process of step S001, and the processes described above are repeated.

Figure 12:
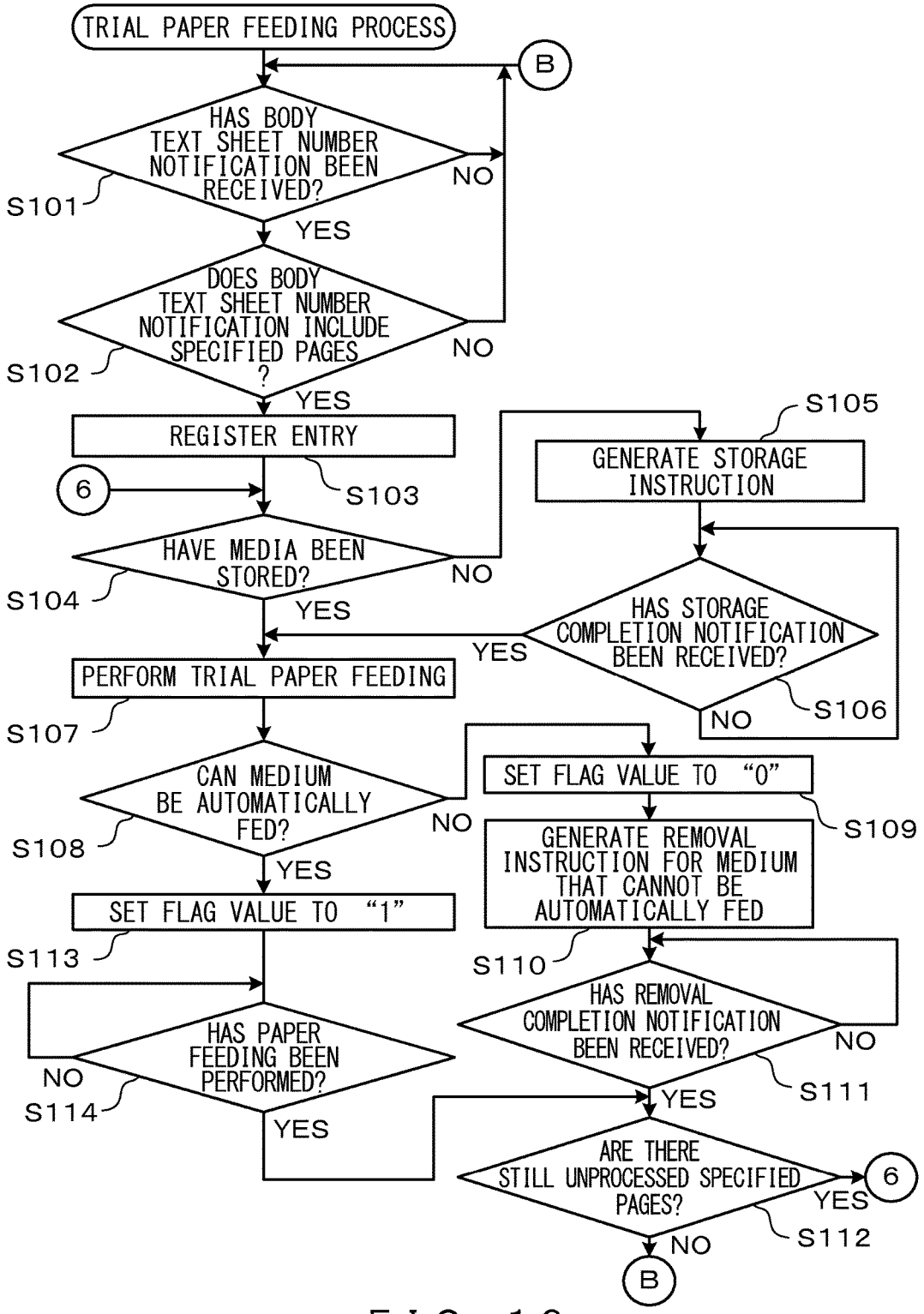
FIG. 12 is an example of a flowchart explaining a flow of a trial paper feeding process according to the embodiment.

With reference to FIG. 12, a flow of a trial paper feeding process according to the embodiment is describe next. FIG. 12 is an example of a flowchart explaining the flow of the trial paper feeding process according to the embodiment. The trial paper feeding process is performed on the side of the case bookbinding device 30, and is commenced by using the reception of a body text sheet number notification as a trigger.

The determination unit 308*a* determines whether a body text sheet number notification has been received (step S101). When the determination unit 308*a* determines that a body text sheet number notification has not been received (step S101: NO), the process of step S101 is repeated, and the reception of a body text sheet number notification is awaited.

When it is determined that a body text sheet number notification has been received (step S101: YES), the determination unit 308*a* further determines whether there are specified pages on the basis of whether the received body text sheet number notification includes insertion position information (step S102). When the determination unit 308*a* determines that there are not specified pages (step S102: NO), the process returns to the process of step S101, and the processes described above are repeated.

When the determination unit 308*a* determines that there are specified pages (step S102: YES), the trial paper feeding control unit 308*c* registers an entry in the automatic paper-feeding-propriety management table 1 on the basis of the insertion position information included in the received body text sheet number notification (step S103). The determination unit 308*a* determines whether media (paper bundles) TG to be manually fed have been stored in the paper feeding tray 36 (step S104).

When the determination unit 308*a* determines that no media (paper bundles) TG have been stored (step S104: NO), the notification unit 308*e* generates a storage instruction, and transmits the generated storage instruction to the coupled printer 20 via the communication unit 301 (step S105). The determination unit 308*a* determines whether a storage completion notification has been received (step S106).

When the determination unit 308*a* determines that a storage completion notification has not been received (step S106: NO), the process of step S106 is repeated, and the reception of a storage completion notification is awaited. When the determination unit 308*a* determines that a storage completion notification has been received (step S106: YES), the process moves on to the process of step S107 described below.

In the process of step S104, when the determination unit 308*a* determines that media (paper bundles) TG have been stored (step S104: YES), the trial paper feeding control unit 308*c* controls the manual paper feeding unit 304 so as to feed as a trial a medium (paper bundle) TG that has been stored at the bottom of the paper feeding tray 36 (step S107).

The determination unit 308*a* determines whether a medium (paper bundle) TG fed as a trial can be automatically fed (step S108). When the determination unit 308*a* determines that a medium (paper bundle) TG fed as a trial cannot be automatically fed (step S108: NO), the trial paper feeding control unit 308*c* sets a flag value of a corresponding flag in the automatic paper-feeding-propriety management table T1 to "0" (step S109). The notification unit 308*e* generates a removal instruction, and transmits the generated removal instruction to the coupled printer 20 via the communication unit 301 (step S110).

The determination unit 308*a* determines whether a removal completion notification has been received (step S111). When the determination unit 308*a* determines that a removal completion notification has not been received (step S111: NO), the process of step S111 is repeated, and the reception of a removal completion notification is awaited.

When the determination unit 308*a* determines that a removal completion notification has been received (step S111: YES), the determination unit 308*a* further determines whether there remain unprocessed specified pages (step S112). When the determination unit 308*a* determines that there remain unprocessed specified pages (step S112: YES), the process returns to the process of step S104, and the processes described above are repeated. When the determination unit 308*a* determines that there are no unprocessed specified pages (step S112: NO), the process returns to the process of step S101, and the processes described above are repeated.

In step S108, when the determination unit 308*a* determines that a medium (paper bundle) TG fed as a trial can be automatically fed (steps S108: YES), the trial paper feeding control unit 308*c* sets a flag value of a corresponding flag in the automatic paper-feeding-propriety management table T1 to "1" (step S113).

The determination unit 308*a* determines whether a medium (paper bundle) TG for which it is determined that automatic paper feeding can be performed as a result of trial paper feeding has been fed from the paper feeding tray 36 under the control of the paper feeding control unit 308*d* (step S114). When the determination unit 308*a* determines that a medium (paper bundle) TG has not been fed from the paper feeding tray 36 (step S114: NO), the process of step S114 is repeated, and the medium (paper bundle) TG for which it is determined that automatic paper feeding can be performed is waited for to be fed from the paper feeding tray 36. When the determination unit 308*a* determines that a medium (paper bundle) TG has been fed from the paper feeding tray 36 (step S114: YES), the process moves on to the process of step S112.

Figure 13:
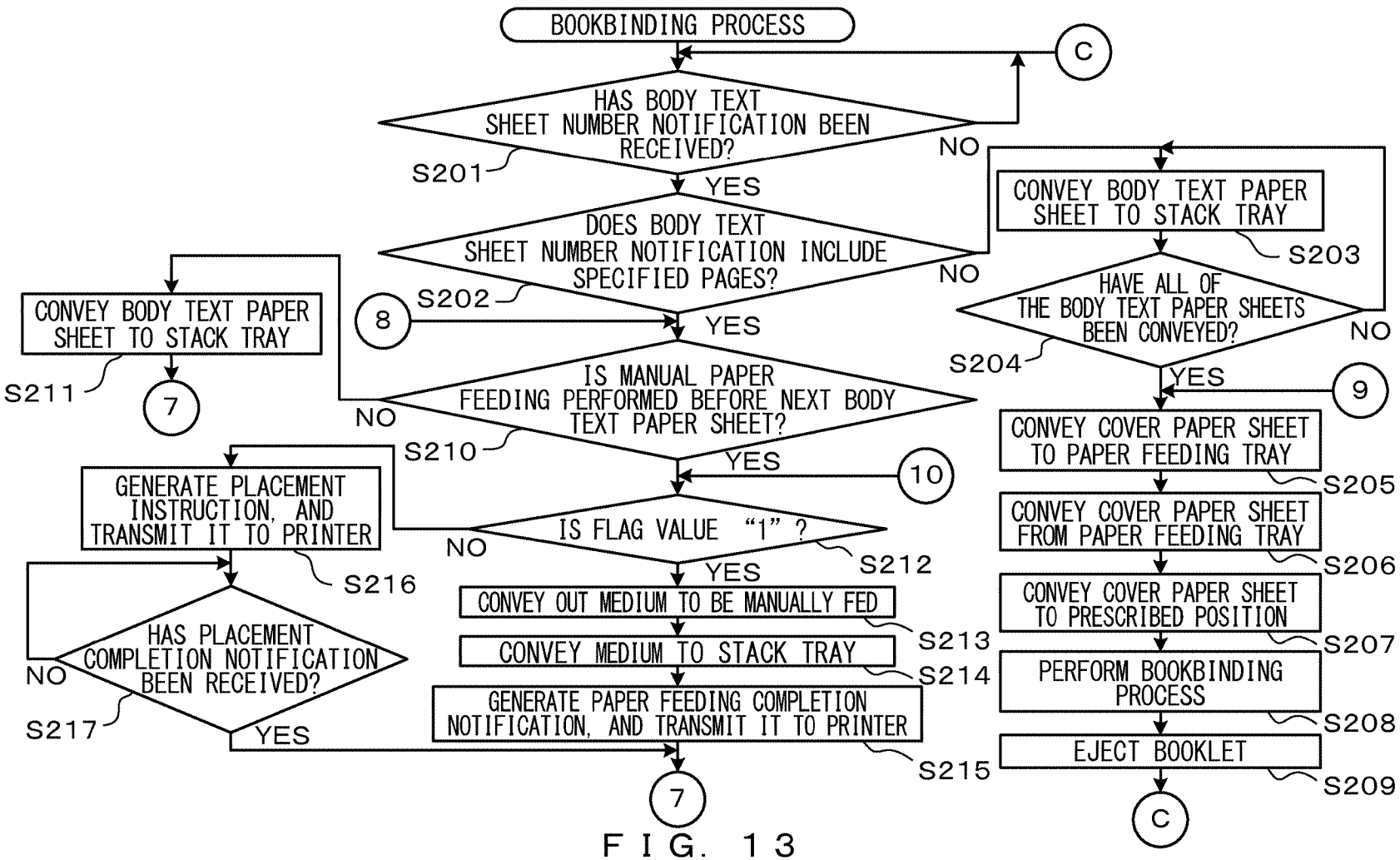
FIG. 13 is a portion of an example of a flowchart explaining a flow of a bookbinding process according to the embodiment.
Figure 14:
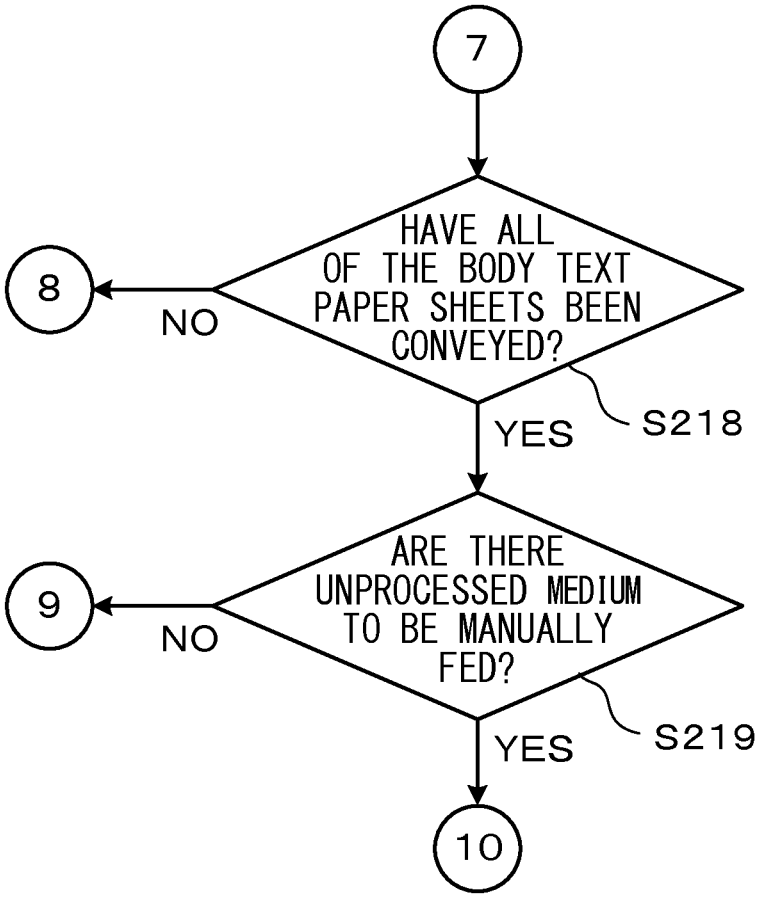
FIG. 14 is another portion of an example of a flowchart explaining a flow of a bookbinding process according to the embodiment.

With reference to FIG. 13 and FIG. 14, a flow of a bookbinding process according to the embodiment is described next. FIG. 13 and FIG. 14 are respective portions of an example of a flowchart explaining the flow of the bookbinding process according to the embodiment. The bookbinding process is performed on the side of the case bookbinding device 30, and is commenced by using the reception of a body text sheet number notification as a trigger.

The determination unit 308*a* determines whether a body text sheet number notification has been received (step S201). When the determination unit 308*a* determines that a body text sheet number notification has not been received (step S201: NO), the process of step S201 is repeated, and the reception of a body text sheet number notification is awaited.

When the determination unit 308*a* determines that a body text sheet number notification has been received (step S201: YES), the determination unit 308*a* further determines whether there are specified pages on the basis of whether the received body text sheet number notification includes insertion position information (step S202). When the determination unit 308*a* determines that there are no specified pages (step S202: NO), the conveyance control unit 308*b* controls the conveyance unit 303 so as to convey a printed body text paper sheet P2 ejected from the printer 20 to the stack tray 34 (step S203).

The determination unit 308*a* determine whether all of the body text paper sheets P2 have been conveyed to the stack tray 34 (step S204). When the determination unit 308*a* determines that not all of the body text paper sheets P2 have been conveyed to the stack tray 34 (step S204: NO), the process returns to the process of step S203, and the processes described above are repeated until all of the body text paper sheets P2 have been conveyed to the stack tray 34.

When the determination unit 308*a* determines that all of the body text paper sheets P2 have been conveyed to the stack tray 34 (step S204: YES), the conveyance control unit 308*b* controls the conveyance unit 303 so as to convey a printed cover paper sheet P1 ejected from the printer 20 to the paper feeding tray 36 (step S205). The paper feeding control unit 308*d* controls the manual paper feeding unit 304 so as to convey out the printed cover paper sheet P1 that has been made to temporarily wait in the paper feeding tray 36 (step S206), and the conveyance control unit 308*b* controls the conveyance unit 303 so as to convey the conveyed-out printed cover paper sheet P1 to a prescribed position of the case binding mechanism 306 (step S207).

The mechanism control unit 308*f* controls the aligning unit 305 and the case binding mechanism 306 so as to manufacture a booklet B on the basis of the cover paper sheet P1 and the body text paper bundle PS (step S208). The ejection control unit 308*g* controls the ejection unit 307 so as to eject the manufactured booklet B to the outside of the housing 31 (step S209). The process returns to the process of step S201, and the processes descried above are repeated.

In the process of step S202, when it is determined that there are specified pages (step S202: YES), the determination unit 308*a* further determines whether manual paper feeding will be performed before a body text paper sheet P2 to be ejected next from the printer 20 (step S210). When manual paper feeding is performed before a body text paper sheet P2 to be ejected next but when all of the media (paper bundles) to be manually fed have been manually fed, the determination unit 308*a* determines that manual paper feeding will not be performed.

When the determination unit 308*a* determines that manual paper feeding will not be performed (step S210: NO), the conveyance control unit 308*b* controls the conveyance unit 303 so as to convey a printed body text paper sheet P2 ejected from the printer 20 to the stack tray 34 (step S211). The process moves on to the process of step S218 described below.

When it is determined that manual paper feeding will be performed (step S210: YES), the determination unit 308*a* further refers to the automatic paper-feeding-propriety management table T1, and determines whether a flag value of a corresponding flag is "1" (step S212). When the column "flag" in the automatic paper-feeding-propriety management table T1 that corresponds to a medium (paper bundle) TG to be processed is blank, at least a flag value that corresponds to the medium (paper bundle) TG to be processed is awaited to be set. Namely, the medium (paper bundle) TG to be processed is awaited to be fed as a trial such that the propriety of automatic paper feeding is determined.

When the determination unit 308*a* determines that a flag value is "1" (step S212: YES), the paper feeding control unit

308*d* controls the manual paper feeding unit 304 so as to convey a medium (paper bundle) TG for which it is determined that automatic paper feeding can be performed (a medium (paper bundle) TG at a bottom) from the paper feeding tray 36 (step S213).

The conveyance control unit 308*b* controls the conveyance unit 303 so as to convey the conveyed-out medium (paper bundle) TG to the stack tray 34 (step S214). The notification unit 308*e* generates a paper feeding completion notification, and transmits the generated paper feeding completion notification to the coupled printer 20 via the communication unit 301 (step S215). The process moves on to the process of step S218 described below.

In the process of step S212, when the determination unit 308*a* determines that a flag value is not "1" (step S212: NO), the notification unit 308*e* generates a placement instruction, and transmits the generated placement instruction to the coupled printer 20 via the communication unit 301 (step S216). As a result, a medium (paper bundle) TG that cannot be automatically fed is placed directly on the stack tray 34.

The determination unit 308*a* determines whether a placement completion notification has been received (step S217). When the determination unit 308*a* determines that a placement completion notification has not been received (steps S217: NO), the process of step S217 is repeated, and the reception of a placement completion notification is awaited. When it is determined that a placement completion notification has been received (step S217: YES), the determination unit 308*a* further determines whether all of the body text paper sheets P2 have been conveyed to the stack tray 34 (step S218).

When the determination unit 308*a* determines that not all of the body text paper sheets P2 have been conveyed to the stack tray 34 (step S218: NO), the process returns to the process of S210, and the processes described above are repeated. When it is determined that all of the body text paper sheets P2 have been conveyed to the stack tray 34 (step S218: YES), the determination unit 308*a* further determines whether there are unprocessed media (paper bundles) TG to be manually fed (step S219).

When the determination unit 308*a* determines that there are unprocessed media (paper bundles) TG to be manually fed (step S219: YES), the process returns to the process of step S212, and the processes described above are repeated. When the determination unit 308*a* determines that there are no unprocessed media (paper bundles) TG to be manually fed (step S219: NO), the process moves on to the process of step S205.

Figure 15:
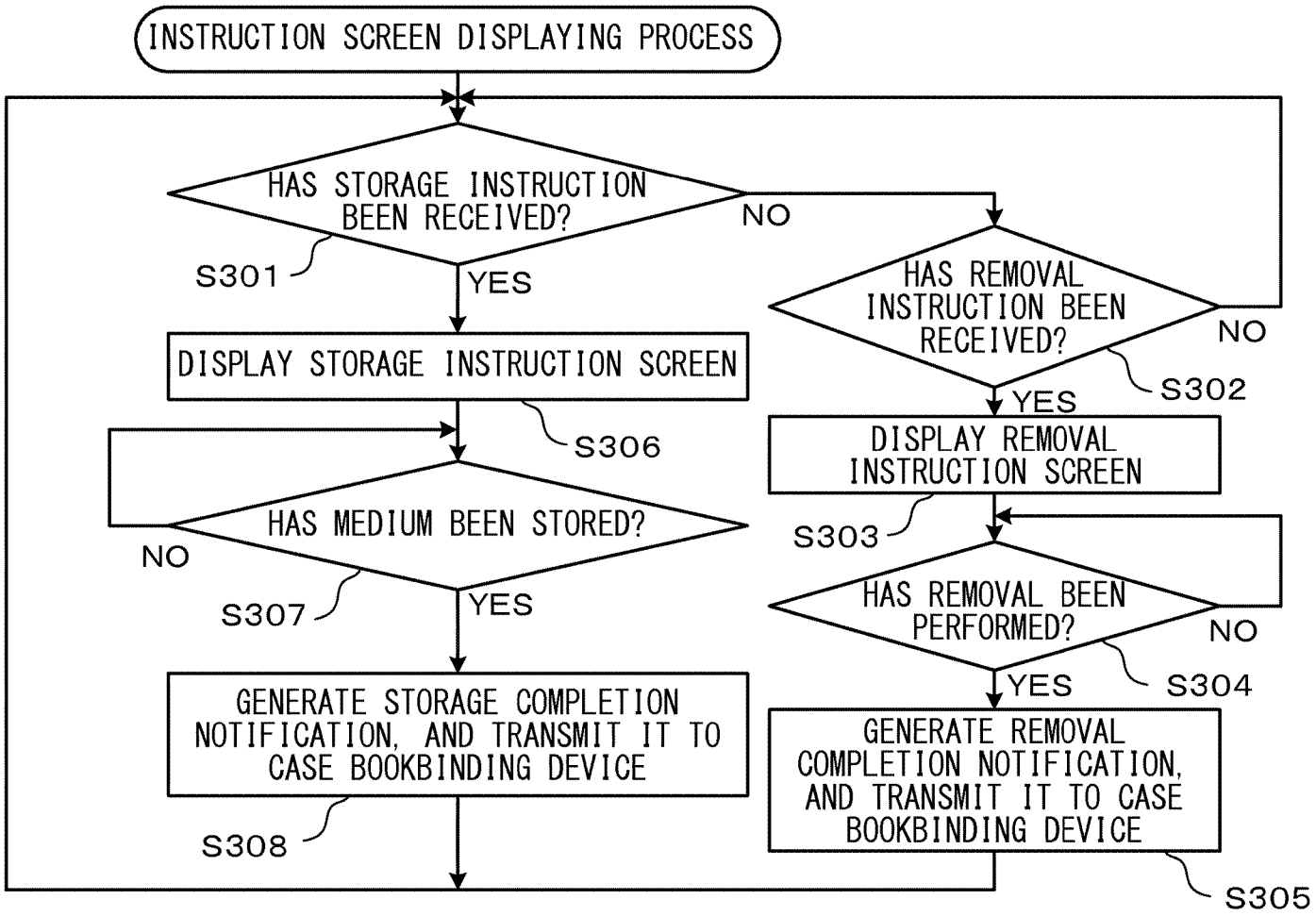
FIG. 15 is an example of a flowchart explaining a flow of an instruction screen displaying process according to the embodiment.

With reference to FIG. 15, a flow of an instruction screen displaying process according to the embodiment is described next. FIG. 15 is an example of a flowchart explaining the flow of the instruction screen displaying process according to the embodiment. The instruction screen displaying process is performed on the side of the printer 20, and is commenced by using the reception of a storage instruction or a removal instruction as a trigger.

The determination unit 212*a* determines whether a storage instruction has been received (step S301). When the determination unit 212*a* determines that a storage instruction has not been received (step S301: NO), the determination unit 212*a* further determines whether a removal instruction has been received (step S302). When the determination unit 212*a* determines that a removal instruction has not been received (step S302: NO), the process returns to the process of step S301, and the processes described above are repeated.

When the determination unit 212*a* determines that a removal instruction has been received (step S302: YES), the display control unit 212*g* generates a removal instruction screen illustrated in FIG. 7C on the basis of template data of the removal instruction screen stored in the data area of the storage unit 203, and controls the display unit 204 so as to display the generated removal instruction screen on the display screen (step S303). Here, another notification means may be used simultaneously so as to notify a user that a removal instruction screen has been displayed.

The determination unit 212*a* determines whether a medium (paper bundle) TG to be manually fed that cannot be automatically fed has been removed from the paper feeding tray 36 on the basis of whether the "Continue" button on the removal instruction screen has been selected (step S304). When the determination unit 212*a* determines that removal has not been performed (step S304: NO), the process of step S304 is repeated, the medium (paper bundle) TG to be manually fed that cannot be automatically fed is awaited to be removed, and the "Continue" button is awaited to be selected.

When the determination unit 212*a* determines that removal has been performed (step S304: YES), the notification unit 212*c* generates a removal completion notification, and transmits the generated removal completion notification to the coupled case bookbinding device 30 via the second communication unit 202 (step S305). The process returns to the process of step S301, and the processes described above are repeated.

In the process of step S301, when the determination unit 212*a* determines that an storage instruction has been received (step S301: YES), the display control unit 212*g* generates a storage instruction screen illustrated in FIG. 7B on the basis of template data of the storage instruction screen stored in the data are of the storage unit 203, and controls the display unit 204 so as to display the generated storage instruction screen on the display screen (step S306). Here, another notification means may be used simultaneously so as to notify a user that the storage instruction screen has been displayed.

The determination unit 212*a* determines whether a medium (paper bundle) TG to be manually fed has been stored in the paper feeding tray 36 on the basis of whether the "Continue" button on the storage instruction screen has been selected (step S307). When the determination unit 212*a* determines that a medium (paper bundle) TG to be manually fed has not been stored (step S307: NO), the process of step S307 is repeated, the medium (paper bundle) TG to be manually fed is awaited to be stored in the paper feeding tray 36, and the "Continue" button is awaited to be selected.

When the determination unit 212*a* determines that a medium (paper bundle) TG to be manually fed has been stored (step S307: YES), the notification unit 212*c* generates a storage completion notification, and transmits the generated storage completion notification to the coupled case bookbinding device 30 via the second communication unit 202 (step S308). The process returns to the process of step S301, and the processes described above are repeated.

With reference to FIG. 2, FIG. 8, and FIGS. 10-16, a flow of a notification communicated between the printer 20 and the case bookbinding device 30 that configure the bookbinding system 1, and a flow of the formation of a body text paper bundle PS are described next in accordance with a specific example. FIG. 16A is a diagram explaining the flow of a notification communicated between the printer 20 and the case bookbinding device 30 that configure the bookbinding system 1 according to the embodiment, and the flow of the formation of a body text paper bundle PS. FIG. 16B illustrates an example of a body text paper bundle PS formed as a result of a process illustrated in FIG. 16A. The descriptions below are not necessarily given along time series.

Figure 16A:
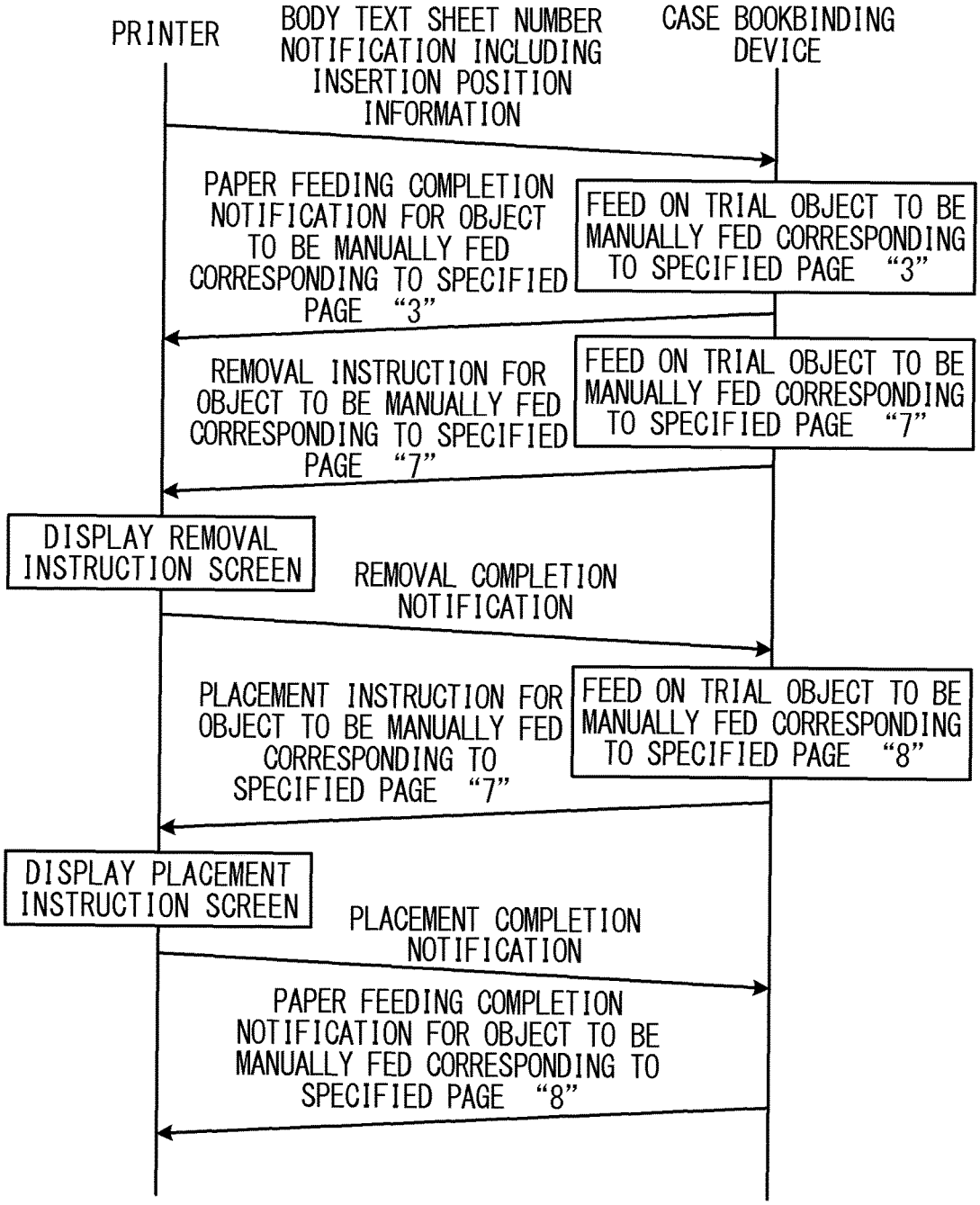
FIG. 16A is a diagram explaining a flow of a notification communicated between a printer and a case bookbinding device that configure a bookbinding system according to the embodiment, and a flow of the formation of a body text paper bundle.

FIG. 16A is a diagram explaining a flow of a notification in the bookbinding system 1 in accordance with a setting example in the case bookbinding print setting illustrated in FIG. 2. An automatic paper-feeding-propriety management table T1 that corresponds to the setting example in the case bookbinding print setting illustrated in FIG. 2 is assumed to be the automatic paper-feeding-propriety management table illustrated in FIG. 8. Namely, an "insertion position" that corresponds to the specified page "3" is "2", an "insertion position" that corresponds to the specified page "7" is "4", and an "insertion position" that corresponds to the specified page "8" is "5". The number of printed body text paper sheets P2 in this example is 5.

In the printing process on the side of the printer 20, upon receipt of a print job generated in accordance with the case bookbinding print setting illustrated in FIG. 2, because specified pages have been set (S003: YES), the notification unit 212*c* generates a body text sheet number notification that includes insertion position information, and transmits the generated body text sheet number notification to the case bookbinding device 30 (step S004). The insertion position information in this case is information in which insertion position (a number specified by the notification unit 212*c*) is associated with each of the specified pages, as described above.

Because manual paper feeding is not performed before the first body text paper sheet P2 (step S007: NO), the printer 20 performs a printing process on the first body text paper sheet P2, and conveys the first body text paper sheet P2 to the case bookbinding device 30 (steps S013-S016). Because a medium (paper bundle) TG that corresponds to the specified page "3" is manually fed before the second body text paper sheet P2 (step S007: YES), the printer 20 awaits the reception of a paper feeding completion notification or a placement completion notification.

In the trial paper feeding process on the side of the case bookbinding device 30, upon receipt of a body text paper sheet notification, because the received body text sheet number notification includes insertion position information (step S102: YES), the trial paper feeding control unit 308*c* registers an entry in the automatic paper-feeding-propriety management table T1 on the basis of the insertion position information (step S103). Namely, the trial paper feeding control unit 308*c* generates the automatic paper-feeding-propriety management table T1 illustrated in FIG. 8. At this point of time, respective columns "flag" are blank.

When media (paper bundles) TG to be manually fed have been stored in the paper feeding tray 36 (step S104: YES), the trial paper feeding control unit 308*c* performs trial paper feeding on the medium (paper bundle) TG that corresponds to the specified page "3" (step S107). In this example, when the medium (paper bundle) TG that corresponds to the specified page "3" can be automatically fed as a result of the trial paper feeding (step S108: YES), the trial paper feeding control unit 308*c* sets a flag value that corresponds to the specified page "3" in the automatic paper-feeding-propriety management table T1 to "1", as illustrated in FIG. 8 (step S113).

In the bookbinding process on the side of the case bookbinding device 30, because manual paper feeding is not performed before the first body text paper sheet P2 (step S210: YES), the conveyance control unit 308*b* controls the conveyance unit 303 so as to convey the first body text paper sheet P2 to the stack tray 34 (step S211). As illustrated in FIG. 8, because manual paper feeding is performed before the second body text paper sheet P2 (step S210: YES), and because the flag value that corresponds to the specified page "3" of the medium to be manually fed is "1" (step S212: YES), the paper feeding control unit 308*d* controls the manual paper feeding unit 304 so as to convey the medium (paper bundle) TG that corresponds to the specified page "3" from the paper feeding tray 36 (step S213). The conveyance control unit 308*b* controls the conveyance unit 303 so as to convey the conveyed-out medium (paper bundle) TG that corresponds to the specified page "3" to the stack tray 34 (step S214).

The notification unit 308*e* generates a paper feeding completion notification that corresponds to the specified page "3", and transmits the generated paper feeding completion notification to the printer 20 (step S215).

In the printing process on the side of the printer 20, upon receipt of the paper feeding completion notification that corresponds to the specified page "3" (step S008: YES), because all of the media (paper bundles) to be manually fed before the second body text paper sheet P2 have been manually fed (step S007: NO), the printer 20 performs a printing process on the second body text paper sheet P2, and conveys the second body text paper sheet P2 to the case bookbinding device 30 (steps S013-S016). Because manual paper feeding is not performed before the third body text paper sheet P2 (step S007: NO), the printer 20 performs a printing process on the third body text paper sheet P2, and conveys the third body text paper sheet P2 to the case bookbinding device 30 (steps S013-S016). Because a medium (paper bundle) TG that corresponds to the specified page "7" is manually fed before the fourth body text paper sheet P2 (step S007: YES), the printer 20 awaits the reception of a paper feeding completion notification or a placement instruction.

In the trial paper feeding process on the side of the case bookbinding device 30, because a medium (paper bundle) TG that corresponds to the specified page "3" has been fed (step S114: YES) and there are unprocessed specified pages (step S112: YES), the trial paper feeding control unit 308*c* performs trial paper feeding on a medium (paper bundle) TG that corresponds to the specified page "7" (step S107). In this example, when the medium (paper bundle) TG that corresponds to the specified page "7" cannot be automatically fed as a result of trial paper feeding (step S108: NO), the trial paper feeding control unit 308*c* sets a flag value that corresponds to the specified page "7" in the automatic paper-feeding-propriety management table T1 to "0", as illustrated in FIG. 8 (step S109). The notification unit 308*e* then generates a removal instruction for the specified page "7", and transmits the generated removal instruction to the printer 20 (step S110).

In the instruction screen displaying process on the side of the printer 20, upon receipt of the removal instruction for the specified age "7" (step S302: YES), the display control unit 212*g* generates a removal instruction screen, and controls the display unit 204 so as to display the generated removal instruction screen on the display screen (step S303). When a user removes the medium (paper bundle) TG that corresponds to the specified page "7" from the paper feeding tray 36 in accordance with the removal instruction, and selects the "Continue" button on the removal instruction screen (step S304: YES), the notification unit 212*c* generates a removal completion notification, and transmits the generated removal completion notification to the case bookbinding device 30 (step S305).

In the trial paper feeding process on the side of the case bookbinding device 30, upon receipt of the removal completion notification (step S111: YES), because there are unprocessed specified pages (step S112: YES), the trial paper feeding control unit 308*c* performs trial paper feeding on a medium (paper bundle) TG that corresponds to the specified page "8" (step S107). In this example, when the medium (paper bundle) TG that corresponds to the specified page "8" can be automatically fed as a result of trial paper feeding (step S108: YES), the trial paper feeding control unit 308*c* sets a flag value that corresponds to the specified page "8" in the automatic paper-feeding-propriety management table T1 to "1", as illustrated in FIG. 8 (step S113).

In the bookbinding process on the side of the case bookbinding device 30, because all of the media (paper bundles) to be manually fed before the second body text paper sheet P2 have been manually fed (step S210: NO), the conveyance control unit 308*b* controls the conveyance unit 303 so as to convey the second body text paper sheet P2 to the stack tray 34 (step S211). Because manual paper feeding is not performed before the third body text paper sheet P2 (step S210: NO), the conveyance control unit 308*b* controls the conveyance unit 303 so as to convey the third body text paper sheet P2 to the stack tray 34 (step S211). As illustrated in FIG. 8, because manual paper feeding is performed before the fourth body text paper sheet P2 (step S210: YES) and a flag value that corresponds to the specified page "7" of a medium to be manually fed is "0" (step S212: NO), the notification unit 308*e* generates a replacement instruction that corresponds to the specified page "7", and transmits the generated placement instruction to the printer 20 (step S216).

In the printing process on the side of the printer 20, upon receipt of the placement instruction that corresponds to the specified page "7" (step S009: YES), the display control unit 212*g* generates a placement instruction screen illustrated in FIG. 7A, and controls the display unit 204 so as to the generated placement instruction screen on the display screen (step S010). When a user opens the upper surface cover, directly places the medium (paper bundle) TG that corresponds to the specified page "7" on the stack tray 34, and selects the "Continue" button on the placement instruction screen, in accordance with the placement instruction (step S011: YES), the notification unit 212*c* generates a placement completion instruction, and transmits the generated placement completion notification to the case bookbinding device 30 (step S012). Because all of the media to be manually fed before the fourth body text paper sheet P2 have been manually fed (step S007: NO), the printer 20 performs a printing process on the fourth body text paper sheet P2, and conveys the fourth body text paper sheet P2 to the case bookbinding device 30 (steps S013-S016). Because a medium (paper bundle) TG that corresponds to the specified page "8" is manually fed before the fifth body text paper sheet P2 (step S007: YES), the printer 20 awaits the reception of a paper feeding completion notification or a placement instruction.

In the bookbinding process on the side of the case bookbinding device 30, because all of the media to be manually fed before the fourth body text paper sheet P2 have been manually fed (step S210: NO), the conveyance control unit 308*b* controls the conveyance unit 303 so as to convey the fourth body text paper sheet P2 to the stack tray 34 (step S211). Because manual paper feeding is performed before the body text paper sheet P2 (step S210: YES) and a flag value that corresponds to the specified page "8" of a medium to be manually fed is "1", as illustrates in FIG. 8 (step S212: YES), the paper feeding control unit 308*d* controls the manual paper feeding unit 304 so as to convey a medium (paper bundle) TG that corresponds to the specified page "8" from the paper feeding tray 36 (step S213). The conveyance control unit 308*b* then controls the conveyance unit 303 so as to convey the conveyed-out medium (paper bundle) TG that corresponds to the specified page "8" to the stack tray 34 (step S214).

The notification unit 308*e* then generates a paper feeding completion notification for the specified page "8", and transmits the generated paper feeding completion notification to the printer 20 (step S215).

In the printing process on the side of the printer 20, upon receipt of the paper feeding completion notification for the specified page "8" (step S008: YES), because all of the media to be manually fed before the fifth body text paper sheet P2 have been manually fed (step S007: NO), the printer 20 performs a printing process on the fifth body text paper sheet P2, and conveys the fifth body text paper sheet P2 to the case bookbinding device 30 (steps S013-S016).

In the bookbinding process on the side of the case bookbinding device 30, because all of the media to be manually fed before the fifth body text paper sheet P2 have been manually fed (step S210: NO), the conveyance control unit 308*b* controls the conveyance unit 303 so as to convey the fifth body text paper sheet P2 to the stack tray 34 (step S211).

Figure 16B:
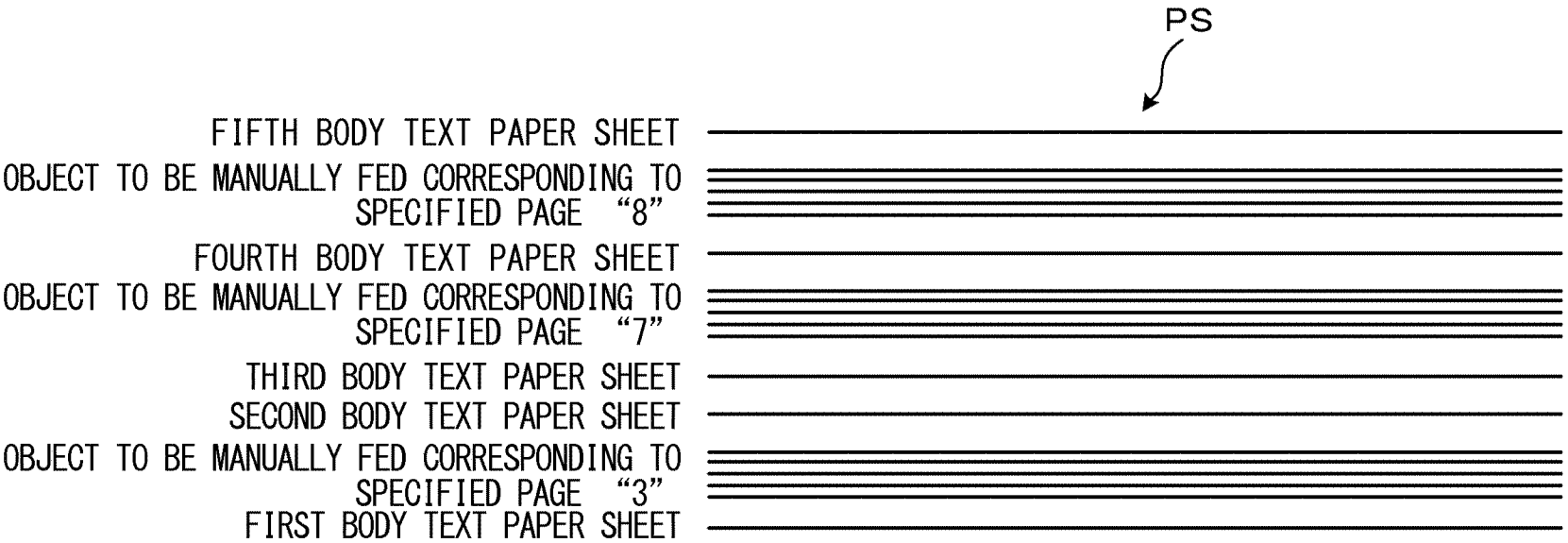
FIG. 16B illustrates an example of a body text paper bundle formed in a process illustrated in FIG. 16A.

As a result of the process described above in the bookbinding system 1, a body text paper bundle PS illustrated in FIG. 16B is formed.

According to the embodiment above, the case bookbinding device 30 includes the aligning unit 305 that stores printed body text paper sheets P2 conveyed from the printer 20, and that forms a body text paper bundle PS, the manual paper feeding unit 304 that stores an object to be manually fed, and that conveys out the stored object to be manually fed under the control of the paper feeding control unit 308*d*, the conveyance unit 303 that conveys the conveyed-out object to be manually fed to the aligning unit 305 under the control of the conveyance control unit 308*b*, the paper feeding control unit 308*d* that controls the manual paper feeding unit 304 so as to convey out the stored object to be manually fed, and the conveyance control unit 308*b* that controls the conveyance unit 303 so as to convey the conveyed-out object to be manually fed to the aligning unit 305. The paper feeding control unit 308*d* controls the manual paper feeding unit 304 and the conveyance unit 303 in cooperation with the paper feeding control unit 308*d* so as to convey the object to be manually fed to the aligning unit 305 after body text paper sheets P2 that includes a page immediately before a page specified by a print job are stored in the aligning unit 305 and before the next body text paper sheet P2 is stored in the aligning unit 305. This allows a user to manually feed a portion of a booklet to be manufactured at a desired timing.

In addition, according to the embodiment above, the case bookbinding device 30 includes the trial paper feeding control unit 308*c* that controls the manual paper feeding unit 304 so as to perform trial paper feeding of a medium (paper bundle) TG before the medium (paper bundle) TG is conveyed from the paper feeding tray 36 of the manual paper feeding unit 304, and is conveyed to the stack tray 34 of the aligning unit 305, and the determination unit 308*a* that determines whether the medium (paper bundle) TG can be automatically fed from the paper feeding tray 36 on the basis of whether the medium detection sensor C1 detects the medium (paper bundle) TG as a result of the trial paper feeding. When it is determined that the medium (paper bundle) TG can be automatically fed, the paper feeding control unit 308*d* controls the manual paper feeding unit 304 and the conveyance unit 303 in cooperation with the conveyance control unit 308*b* so as to convey an object to be manually fed to the aligning unit 305 after body text paper sheets P2 that includes a page immediately before a page specified by a print job are stored in the aligning unit 305 and before the next body text paper sheet P2 is stored in the aligning unit 305. This allows a failure to automatically feed a medium (paper bundle) TG to be prevented.

According to the embodiment above, the determination unit 308*a* determines whether a medium (paper bundle) TG can be automatically fed from the paper feeding tray 36 before body text paper sheets P2 that includes a page immediately before a page specified by a print job are stored in the aligning unit 305. This allows the time to be effectively utilized, compared with a case in which a determination process of trial paper feeding is performed after body text paper sheets P2 that includes a page immediately before a page specified by a print job are stored in the aligning unit 305. Accordingly, booklet manufacture efficiency can be improved.

According to the embodiment above, the manual paper feeding unit 304 includes a conveying-out roller R that conveys out a medium (paper bundle) TG from the paper feeding tray 36, and a motor (not illustrated) that drives the conveying-out roller R, and the trial paper feeding control unit 308*c* revolves the conveying-out roller R during a prescribed time period TM (s) at a lower speed than the speed in a case in which a medium (paper bundle) TG is conveyed out in order to convey the medium (paper bundle) TG to the stack tray 34. This allows a scraping due to the conveying-out roller R to be reduced in a case in which a medium (paper bundle) TG cannot be automatically fed.

According to the embodiment above, the case bookbinding device 30 includes the notification unit 308*e* that, when it is determined that a medium (paper bundle) TG cannot be automatically fed, generates a removal instruction in order to notify a user that the medium (paper bundle) TG cannot be conveyed out, and that transmits the generated removal instruction to the printer 20, and the upper surface cover that enables a user to directly store the medium (paper bundle) TG that cannot be automatically fed in the stack tray 34. By doing this, the medium (paper bundle) TG that cannot be automatically fed is directly stored in the stack tray 34, and therefore the manufacture of a booklet B can be continued.

In the trial paper feeding according to the embodiment above, it has been described that it is determined whether an object to be manually fed can be automatically fed on the basis of whether the medium detection sensor C1 detects a medium before a prescribed time period TM (s) has passed after the conveying-roller R starts to be driven. However, the present invention is not limited to this, and, as an example, a motor that drives the conveying-out roller R may be a stepping motor, and it may be determined whether an object to be manually fed can be automatically fed on the basis of whether the medium detection sensor C1 detects a medium before the number of steps after the commencement of the driving of the conveying-out roller R reaches a prescribed number of steps.

In the embodiment above, a description has been given under the assumption that the number of manufactured booklet B is one, but the present invention can be applied to a case in which a plurality of booklets B having the same content are manufactured.

In the embodiment above, it has been described that the "specified page for manual paper feeding" specifies a page immediately after an inserted medium (paper bundle) TG to be manually fed, but the present invention is not limited to this, and the "specified page for manual paper feeding" may specify a page immediately before the inserted medium (paper bundle) TG to be manually fed. In this case, the notification unit 212*c* may specify what order number of body text paper sheet P2 a body text paper sheet P2 immediately before an inserted medium (paper bundle) TG to be manually fed is, on the basis of a specified page set in the case bookbinding print setting. When a medium (paper bundle) TG to be manually fed is inserted before the first body text paper sheet, a manual paper feeding process may be performed, for example, by inputting X1, X2, . . . in the column "specified page for manual paper feeding".

In embodiment above, it has been described that it is determined whether an object to be manually fed can be automatically fed by performing trial paper feeding. However, the present invention is not limited to this, and as an example, an average weight of an object to be manually fed that has been stored in the paper feeding tray 36 may be calculated, and a thickness of the object to be manually fed may be estimated on the calculated average weight, and it may be determined whether automatic paper feeding can be performed on the basis of whether the estimated thickness exceeds a prescribed value. The average weight can be calculated on the basis of a detected weight by providing a weight sensor inside the paper feeding tray 36. The thickness of an object to be manually fed may be estimated by using a ultrasonic sensor or the like.

The processes described above may be performed by storing and distributing an operation program for performing the operation above in a computer-readable recording medium such as a flexible disk, a CD-ROM (Compact Disk-Read Only Memory), a DVD (Digital Versatile Disk), or an MO (Magneto Optical disk), and by installing the operation program onto a computer such as the printer 20. Further, a program may be stored in a disk device or the like that is included in a server device on the internet, may be superimposed on, for example, a carrier, and may be downloaded for example to a computer.

In the meantime, the present invention is not limited to the above mentioned embodiments as they are, but may be embodied in practical uses, by modifying components without departing from a gist of the embodiments. Further, by appropriately combining a plurality of components disclosed in the above mentioned embodiments, various inventions may be configured. For example, all of the components disclosed in the embodiments may be combined as appropriate. Further, the components may be combined appropriately over different embodiments. Within a scope of the invention that does not depart from the gist of the invention, various modifications or applications are possible, as a matter of course.

EXPLANATIONS OF LETTERS OR NUMERALS

| | | | |
|---|---|---|---|
| 100 | Printing system | | |
| | NW | Network | |
| | | 10 | Information terminal device |
| | 1 | Bookbinding system | |
| | | 20 | Printer |
| | | | 201 First communication unit |
| | | | 202 Second communication unit |

-continued

| | | | |
|---|---|---|---|
| | 203 | Storage unit | |
| | 204 | Display unit | |
| | 205 | Operation unit | |
| | 206 | Body text paper sheet feeding unit | |
| | 207 | Cover paper sheet feeding unit | |
| | 208 | Print conveyance unit | |
| | 209 | Printing unit | |
| | 210 | Switchback unit | |
| | 211 | Communication conveyance unit | |
| | 212 | Control unit | |
| | | 212a | Determination unit |
| | | 212b | Analysis unit |
| | | 212c | Notification unit |
| | | 212d | Paper feeding control unit |
| | | 212e | Conveyance control unit |
| | | 212f | Print control unit |
| | | 212g | Display control unit |
| 30 | Case bookbinding device | | |
| | 301 | Communication unit | |
| | 302 | Storage unit | |
| | 303 | Conveyance unit | |
| | 304 | Manual paper feeding unit | |
| | | R | Conveying-out roller |
| | | C1 | Medium detection sensor |
| | | C2 | Storage detection sensor |
| | 305 | Aligning unit | |
| | 306 | Case binding mechanism | |
| | 307 | Ejection unit | |
| | 308 | Control unit | |
| | | 308a | Determination unit |
| | | 308b | Conveyance control unit |
| | | 308c | Trial paper feeding control unit |
| | | 308d | Paper feeding control unit |
| | | 308e | Notification unit |
| | | 308f | Mechanism control unit |
| | | 308g | Ejection control unit |
| T1 | Automatic paper-feeding-propriety management table | | |
| P1 | Cover paper sheet | | |
| P2 | Body text paper sheet | | |
| TG | Medium (paper bundle) to be manually fed | | |
| PS | Body text paper bundle | | |
| B | Booklet | | |
| L | Prescribed distance | | |

What is claimed is:

1. A bookbinding apparatus comprising:

a storing unit that stores a paper bundle that is formed of printed body text paper sheets conveyed from a printer and a medium that is inserted into the body text paper sheets and that is different from the body text paper sheets;

a storage unit that stores the medium that is manually fed;

a conveyance unit that conveys the medium from the storage unit to the storing unit;

a trial paper feeding control unit that performs a trial conveyance in which the medium is conveyed from the storage unit to a prescribed position;

a determination unit that determines, according to a result of the trial conveyance, whether the medium can be conveyed from the storage unit before the body text paper sheets that include a specified page are stored in the storing unit, the specified page being a page specified by a print job; and a control unit that controls the conveyance unit so as to insert the medium into the body text paper sheets based on the specified page, wherein when the determination unit determines that the medium can be conveyed, the control unit controls the conveyance unit so as to convey the medium from the storage unit to the storing unit after the body text paper sheets that include the specified page are stored in the storing unit and before the body text paper sheet conveyed from the printer immediately afterwards is stored in the storing unit, wherein the storage unit includes a conveying roller that conveys the medium, and a driving unit that drives the conveying roller, and wherein in performing the trial conveyance, the trial paper feeding control unit controls the driving unit so as to revolve the conveying roller during a prescribed time period at a lower speed than a speed when the medium is conveyed in order to convey the medium to the storing unit.

2. The bookbinding apparatus according to claim 1, further comprising:

a notification unit that notifies a user that the medium cannot be conveyed when the determination unit determines that the medium cannot be conveyed; and a manual storage permission unit that enables the user to directly store the medium in the storing unit.

* * * * *